US011045938B2

(12) United States Patent
Iwakami et al.

(10) Patent No.: US 11,045,938 B2
(45) Date of Patent: Jun. 29, 2021

(54) POWER TOOL

(71) Applicant: MAKITA CORPORATION, Anjo (JP)

(72) Inventors: Junichi Iwakami, Anjo (JP); Shin Nakamura, Anjo (JP); Akira Mizutani, Anjo (JP); Takafumi Kotsuji, Anjo (JP)

(73) Assignee: MAKITA CORPORATION, Anjo (JP)

( * ) Notice: Subject to any disclaimer, the term of this patent is extended or adjusted under 35 U.S.C. 154(b) by 236 days.

(21) Appl. No.: 15/418,112

(22) Filed: Jan. 27, 2017

(65) Prior Publication Data

US 2017/0225316 A1 Aug. 10, 2017

(30) Foreign Application Priority Data

Feb. 5, 2016 (JP) ..... JP2016-020898

(51) Int. Cl.

| | |
|---|---|
| ***B25F 5/02*** | (2006.01) |
| ***B25F 5/00*** | (2006.01) |
| ***B24B 23/04*** | (2006.01) |
| ***B24B 27/08*** | (2006.01) |
| ***B27B 19/00*** | (2006.01) |

(52) U.S. Cl.

CPC ..... *B25F 5/02* (2013.01); *B24B 23/04* (2013.01); *B24B 27/08* (2013.01); *B25F 5/006* (2013.01); *B25F 5/008* (2013.01); *B27B 19/006* (2013.01)

(58) Field of Classification Search

CPC .. B25F 5/02; B25F 5/006; B25F 5/008; B24B 23/04; B24B 27/085; B24B 27/08; B27B 19/006

See application file for complete search history.

(56) References Cited

U.S. PATENT DOCUMENTS 3,908,139 A * 9/1975 Duncan, Jr. ..... B23B 45/001 310/50
5,466,183 A * 11/1995 Kirn ..... B23D 45/16 173/170

(Continued)

FOREIGN PATENT DOCUMENTS

CN 104209929 A 12/2014
EP 1 080 838 A2 3/2001

(Continued)

OTHER PUBLICATIONS https://www.youtube.com/watch?v=xT1_xyRwlHY (Year: 2015).*

(Continued)

*Primary Examiner* — Anna K Kinsaul
*Assistant Examiner* — Daniel Jeremy Leeds
(74) *Attorney, Agent, or Firm* — Oliff PLC

(57) ABSTRACT

Several means 71, 72, 73, 74, and 75 are provided for restricting a relative displacement in a separating direction of half-split housings 50L, 50R. At one or more of several screw-connection parts 60 of the left and right half-split housings 50L, 50R, a press-fitting protrusion 71*a* is provided in an insertion hole 62*a* of a boss-receiving part 62 into which a screw-boss part 61 is inserted. By press-fitting the screw-boss part 61 to the boss-receiving part 62, a separation resistance may be introduced between the left and right half-split housings 50L, 50R.

25 Claims, 16 Drawing Sheets

(56) References Cited

U.S. PATENT DOCUMENTS 5,565,719 A * 10/1996 Kuhlmann ..... B25F 5/02 310/47
5,759,094 A * 6/1998 Bosten ..... B24B 23/04 451/164
6,810,970 B1 * 11/2004 Kraenzler ..... B24B 23/04 173/213
9,993,915 B2 * 6/2018 Roberts ..... B25D 17/043
2006/0068689 A1 * 3/2006 Kiss ..... B24B 23/04 451/359
2006/0096770 A1 * 5/2006 Roberts ..... B25F 5/02 173/217
2006/0105687 A1 * 5/2006 Lui ..... B24B 23/04 451/359
2006/0156859 A1 * 7/2006 Nemetz ..... B25D 16/00 74/606 R
2006/0201690 A1 * 9/2006 Fehrle ..... B25F 5/02 173/170
2009/0188692 A1 * 7/2009 Hahn ..... B25D 17/043 173/210
2014/0056660 A1 * 2/2014 Eshleman ..... B25B 21/00 408/9
2014/0084552 A1 * 3/2014 Zieger ..... B24B 23/022 279/141
2014/0124230 A1 * 5/2014 Johnson ..... B25F 5/006 173/162.1
2014/0190715 A1 * 7/2014 Wong ..... B25B 21/00 173/39
2014/0190716 A1 * 7/2014 Sugiura ..... B24B 23/04 173/46
2014/0352994 A1 12/2014 Yoshikane et al.
2015/0034347 A1 * 2/2015 Hess ..... B25F 5/006 173/162.2
2015/0152901 A1 * 6/2015 Stieler ..... B25F 5/02 411/367
2015/0202762 A1 * 7/2015 Roberts ..... B25D 17/043 173/162.2
2018/0319001 A1 * 11/2018 Zhong ..... B24B 23/04

FOREIGN PATENT DOCUMENTS

JP S56-56388 A 5/1981
JP S58-171318 U 11/1983
JP 2009-028839 A 2/2009
JP 484409 B2 12/2011
JP 2015-104770 A 6/2015
JP 2015-229223 A 12/2015
WO 2008/090830 A1 7/2008
WO 2015/186715 A1 12/2015

OTHER PUBLICATIONS https://www.youtube.com/watch?v=QsfB5HCE-oQ (Year: 2012).*
Oct. 15, 2019 Office Action issued in Japanese Patent Application No. 2016-020898.
Aug. 10, 2020 Office Action issued in Chinese Patent Application No. 201710035664.5.
Mar. 9, 2021 Office Action issued in Chinese Patent Application No. 201710035664.5.

* cited by examiner

POWER TOOL

CROSS-REFERENCE

This application claims priority to Japanese patent application serial number 2016-20898, filed on Feb. 5, 2016, the contents of which are herein incorporated by reference in their entirety.

TECHNICAL FIELD

The present invention generally relates to a handheld power tool which may be used to perform various types of work, such as the cutting of materials.

BACKGROUND ART

A multifunction power tool, which is referred to as a multi-tool, can perform various kinds of work such as cutting work, peeling work, and grinding work, etc. by swinging a tip tool attached to an output axis of the power tool at a predetermined angle at high speed. The maximum swinging rate of the output axis may reach roughly 200,000 times per minute, which may cause microvibration. Owing to the microvibration, a problem of, for example, damaged operability and/or workability may occur in these types of power tools. Conventionally, in these types of power tools, various countermeasures have been taken to suppress such microvibration. Japanese Laid-Open Patent Publication No. 2015-229223 discloses a technique of suppressing microvibration in multifunction power tools such that a weight device is attached to one end of a motor shaft while an eccentric shaft for producing a swing movement is positioned at the other end of the motor shaft. Aside from this technique, Japanese Patent No. 4844409 discloses a technique of improving drop-impact strength by providing a thin wall part in a grip in pistol-type electric power tools.

Notwithstanding the aforementioned prior art, it is desirable to further suppress the microvibration occurring in multifunction power tools in which swing movement is performed at high speed. Some of the power tools may be configured such that their housing is integrally molded into a tubular body, or a half-split structure having left and right half-split housings made of resin. In the half-split structure, the microvibration caused by the high-speed swing movement can cause mating surfaces of the left and right half-split housings to vibrate at different phases (vibrate mutually) and/or to rub with each other. As a result, a heat generation problem may occur. Furthermore, in a case where a large amount of heat is generated, an additional problem of vibration welding, may occur.

Thus, due to these difficulties, there is a need in the art to solve the problem of heat generation by suppressing a mutual vibration of mating surfaces of the housing in multifunction power tools where the swing movement is performed at high speed.

SUMMARY

In one exemplary embodiment of the present disclosure, a power tool comprises a first half-split housing and a second half-split housing, and the first half-split housing is configured to be mated to the second half-split housing for screw connection. Furthermore, the first and the second half-split housings includes a relative displacement restriction means other than the screw connection for restricting a relative displacement of the first half-split housing with respect to the second half-split housing in a separating direction.

According to the embodiment, the power tool is provided with the relative displacement restriction means other than the screw connection for restricting the relative displacement of the half-split housings in the separating direction. Because of the relative displacement restriction means, a resistance to separation in the separating direction (separation resistance) is introduced between the half-split housings. Because of this element of construction, even if the screw connection is loosened, the half-split housings remain connected in an inseparable manner due to the separation resistance of the relative displacement restriction means.

Furthermore, the separation resistance which aids the half-split housings in remaining connected in a mating manner with each other dually functions as a resistance for restricting a displacement along the mating surfaces of the half-split housings in a longitudinal direction (a direction perpendicular to the separating direction). Thus, because of the separation resistance generated by the relative displacement restriction means, through the dual-function of the means, a relative displacement (vibration and/or rub) in a mating direction of the half-split housings can also be restricted. As a result, heat generation on the mating surface can be prevented and/or restricted.

In another exemplary embodiment of the disclosure, the first half-split housing includes a screw-boss part for fastening a screw, and the second half-split housing includes a boss-receiving part into which the screw-boss part of the first half is inserted. Furthermore, in this embodiment the relative displacement restriction means is configured by the screw-boss part being press-fitted to the boss-receiving part.

According to the embodiment, by press-fitting the screw-boss part to the boss-receiving part, separation resistance is introduced between the half-split housings. As a result, relative displacement (vibration and/or rub) in the mating direction of the half-split housings can be restricted and/or reduced. In the press-fitting structural configuration, an inner diameter of the boss-receiving part is configured to be sized with respect to an outer diameter of the screw-boss part such that the screw-boss part is press-fit to the boss-receiving part. In another structure, a protrusion is provided on an inner surface of the boss-receiving part such that the screw-boss part is press-fit to the boss-receiving part.

In another exemplary embodiment of the disclosure, the relative displacement restriction means is configured such that a press-fitting pin provided in the first half-split housing is press-fit to a press-fitting hole provided in the second half-split housing.

According to the embodiment, the press-fitting pin positioned between the half-split housings can generate the separation resistance. Because of the separation resistance, a relative displacement along the mating surface of the half-split housings in a longitudinal direction can be restricted. As a result, vibration and/or rub of the mating surface in a mating direction can be restricted, which can prevent and/or restrict heat generation.

In another exemplary embodiment of the disclosure, the first half-split housing includes a first mating surface, and the second half-split housing includes a second mating surface. A rib is provided on the first mating surface for restricting the relative displacement of the first half-split housing with respect to the second half-split housing in a mating direction, and a rib-receiving part into which the rib is inserted is provided on the second mating surface. In this manner, the relative displacement restriction means of this embodiment is structurally configured such that the rib is press-fit to the rib-receiving part.

According to the embodiment, the rib press-fit to the rib-receiving part can generate the separation resistance between the half-split housings. As a result, relative displacement (vibration and/or rub) along the mating surface of the half-split housings in a longitudinal direction can be restricted, which can prevent and/or restrict heat generation.

In another exemplary embodiment of the disclosure, a protrusion is provided on the rib, and the protrusion is configured to be elastically deformed such that the rib is press-fit to the rib-receiving part.

According to the embodiment, the protrusion is elastically deformed to be press-fit to the rib-receiving part. The press-fitting structural configuration of the rib with respect to the rib-receiving part is such that the protrusion is provided on a lateral side of the rib. In another structure, the rib is formed in a tapered manner to be press-fit to the rib-receiving part. In another structure, a groove width of the rib-receiving part is sized to be a little smaller than a thickness of the rib to be press-fit to the rib. Furthermore, in another structure, a elastic member such as a rubber sheet etc. is inserted between lateral sides of the rib and the rib-receiving part such that the rib is press-fit to the rib-receiving part.

In another exemplary embodiment of the disclosure, a plurality of ribs are provided on the first mating surface, and the relative displacement restriction means includes at least three ribs.

According to the embodiment, due to the plurality of ribs, relative displacement (vibration and/or rub) along the mating surfaces of the half-split housings in a longitudinal direction can be restricted in a wider area. As a result, heat generation can be more simply and/or more reliably prevented and/or reduced.

In another exemplary embodiment of the disclosure, the power tool further comprises an output shaft that swings at a predetermined angle. Furthermore, the first half-split housing and the second half-split housing are configured to be located left and right with respect to a place including a swing axis of the output shaft.

According to the embodiment, the above-discussed effects can be applied to the half-split housings in the multifunction power tool having a fast swing output shaft.

DETAILED DESCRIPTION OF EMBODIMENTS

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components and/or devices that are shown in block diagram form in order to avoid obscuring significant aspects of the exemplary embodiments presented herein.

Figure 1:
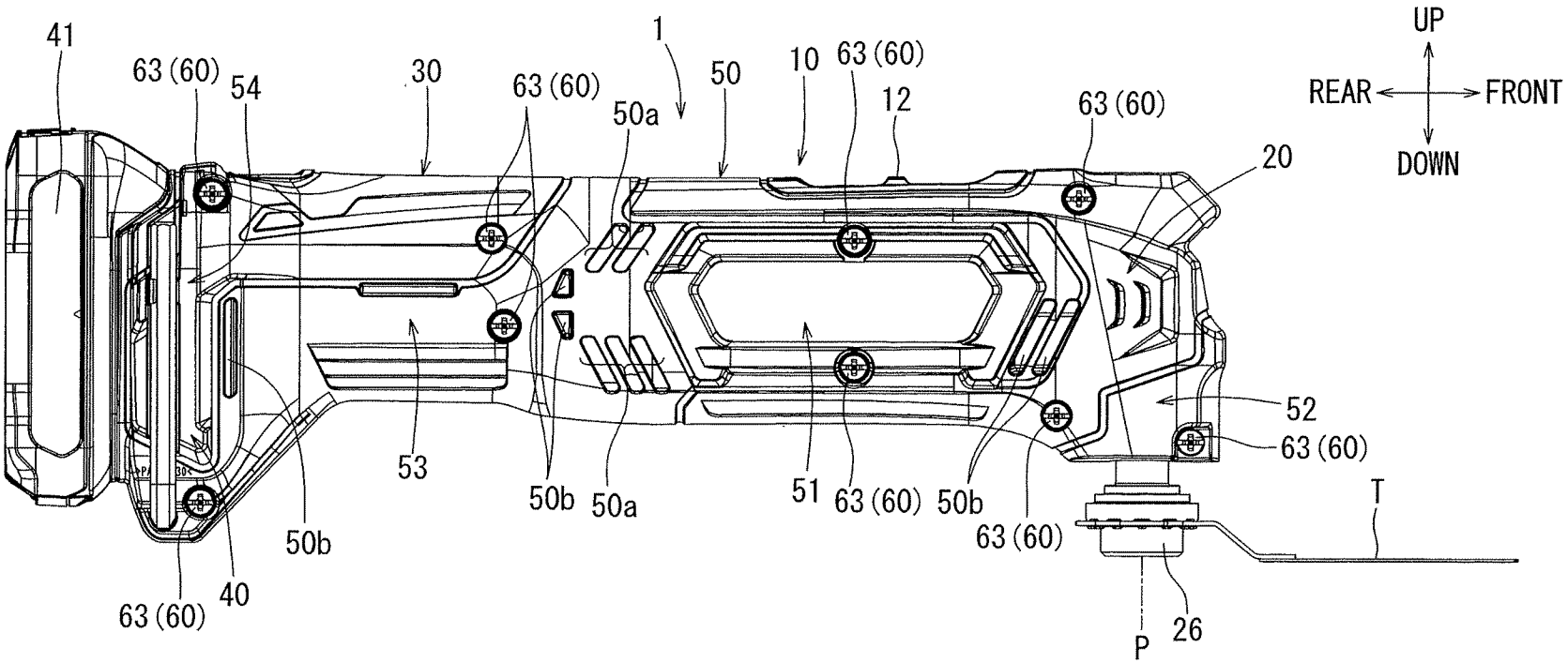
FIG. 1 is an overall side view of a power tool according to an exemplary embodiment of the present disclosure.
Figure 2:
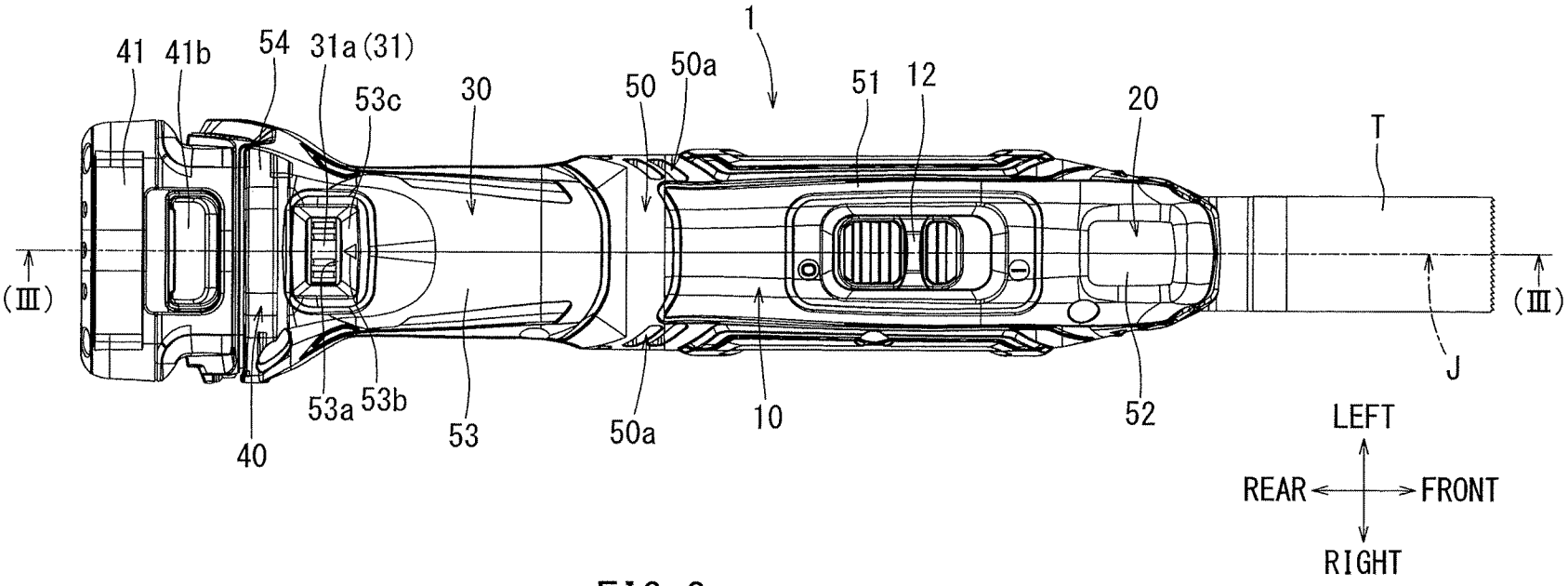
FIG. 2 is an overall plan view of the power tool according to the exemplary embodiment of the present disclosure.
Figure 3:
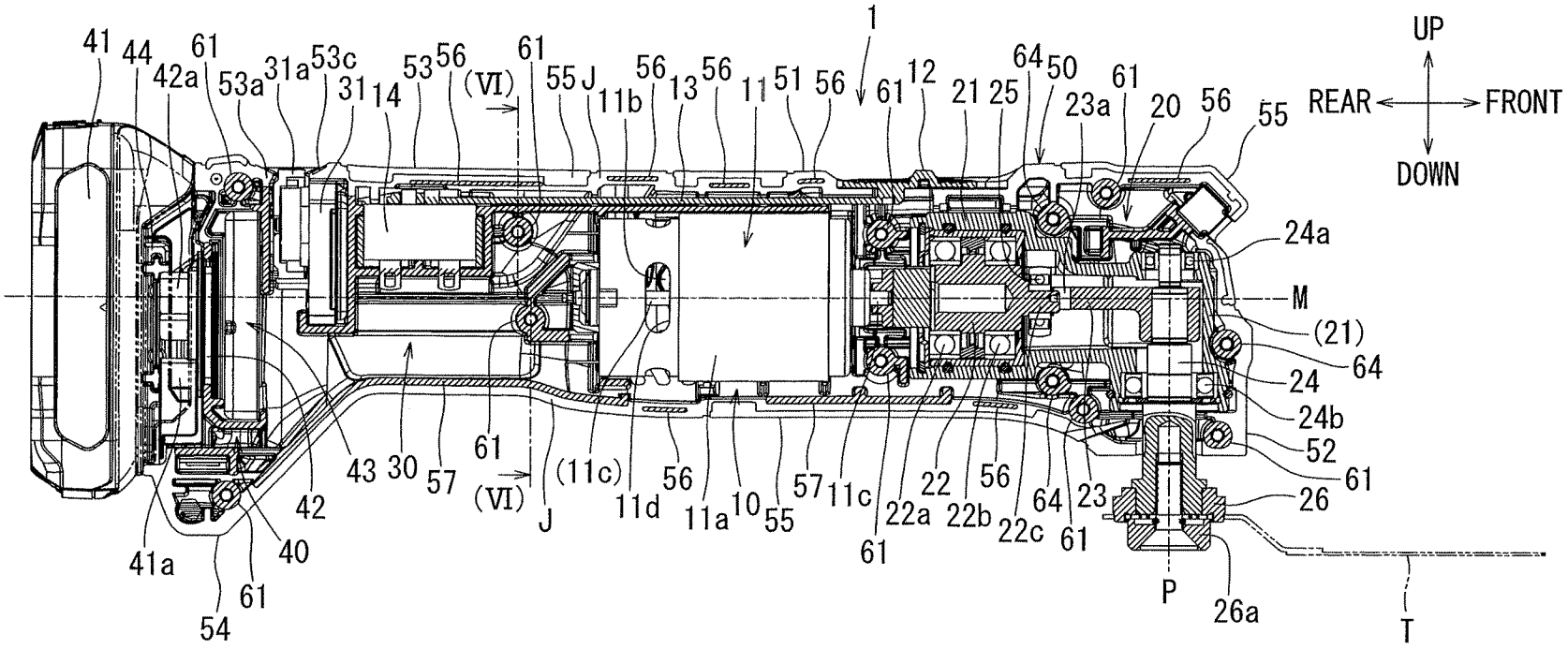
FIG. 3 is a cross-sectional view taken along arrows (III)-(III) in FIG. 2, showing an overall internal structure of a half-split left housing.

Hereinafter, exemplary embodiments of the present teachings will be described with reference to FIGS. 1 to 24. As shown in FIGS. 1 to 3, a multifunction electric power tool may be exemplified as a power tool 1 in each of exemplary embodiments. The power tool 1 may have a configuration in which a tip tool attached to an output shaft of a motor is swung at a predetermined angle at high speed. The power tool 1 may be used for various kinds of work such as, for example, a cutting work of plasterboards, a peeling work of tiles, and a grinding work of wooded materials, etc. Hereinafter, five embodiments will be described below. Each of the five embodiments may have differing features from each other with respect to a connection structure of half-split housings, and a basic structure of the housing, with the exception of the above feature may be common in the five embodiments. Because of this reason, only the embodiment 1 will be explained with regard to the basic structure of the power tool 1, and the subsequent descriptions of the construction in the other four embodiments in common with the first embodiment may be omitted by using the same reference numerals.

The power tool 1 may be provided with a tool main body 10 in which an electric motor 11 is housed as a driving source, a mechanism section 20 that is located in front of the tool main body 10, a grip 30 that is located at a rear part of the tool main body 10, and a power supply section 40 that is located at a rear part of the grip 30. In the power tool 1, the mechanism section 20, the tool main body 10, the grip 30, and the power supply section 40 may be successively arranged in this order from the front side, extending approximately in a straight line along the front-rear axis. The mechanism 20, the tool main body 10, the grip 30, and the power supply section 40 may be housed in roughly a tubular housing 50 that extends along a motor axis M of the electric motor 11. The housing 50 may include left and right half-split housings made from resin. Each of the five embodiments may have a feature in a connection structure of the half-split housings. The housing 50 may be described in detail later.

Figure 4:
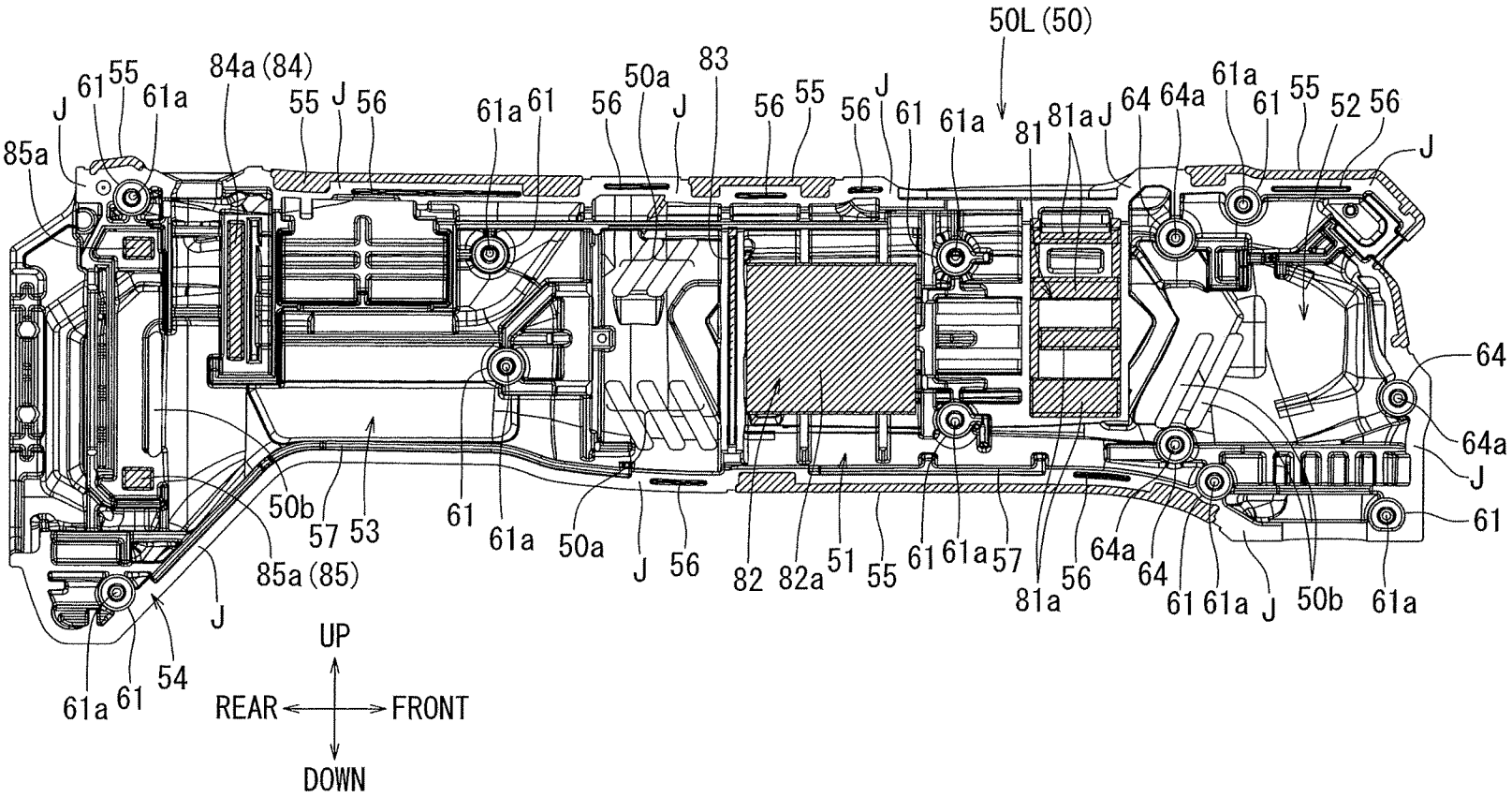
FIG. 4 is a rear-to-front side view of the half-split left housing, as seen from an inner surface side (from a right side, according to the left-right orientation of FIG. 2).
Figure 5:
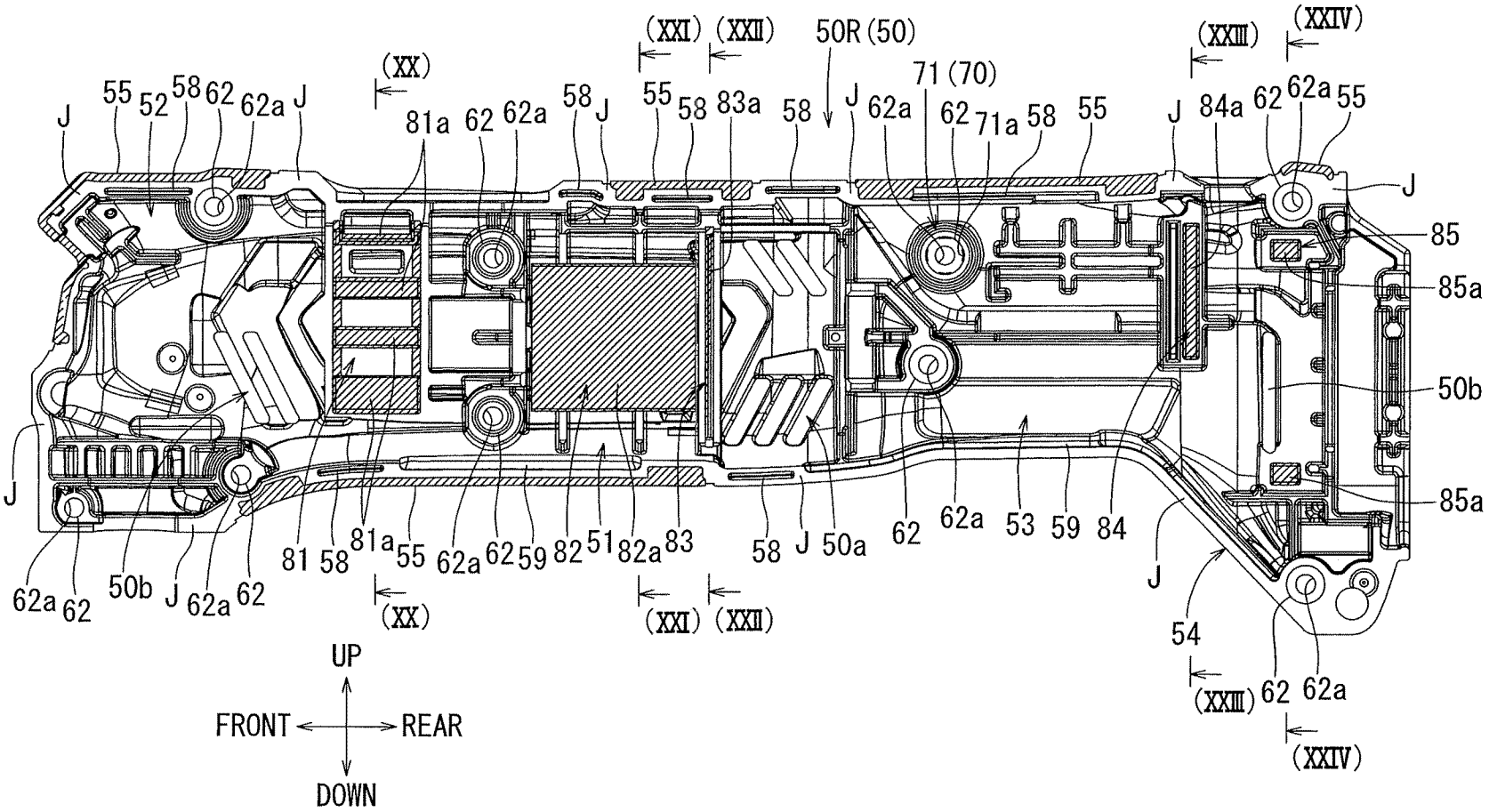
FIG. 5 is front-to-rear side view of the half-split right housing, as seen from an inner surface side (from a left side, according to the left-right orientation of FIG. 2).

As shown in FIG. 3, the electric motor 11 of the tool main body 10 may be housed in a tubular motor case 11*a*. A cooling fan 11*b* attached to a motor axis 11*c* may be housed in the motor case 11*a*. An oval exhaust window 11*d* may be provided at a rear part of the motor case 11*a*. In FIG. 3, the cooling fan 11*b* may be seen via the exhaust window 11*d*. Furthermore, as shown in FIGS. 1, 4, and 5, a plurality of inlet ports 50*b* may be provided at a front side face, a center side face, and a rear side face in a longitudinal direction of the housing 50. Furthermore, a plurality of exhaust ports 50*a* may be provided at approximately a center side-face in the longitudinal direction of the housing, which is located around the exhaust window 11*d*. When the cooling fan 11*b* rotates by the running of the electric motor 11, outside air may be introduced into an inside of the motor case 11*a* via the inlet ports 50*b* to cool the electric motor 11. This air for cooling the electric motor 11 introduced into the inside of the motor case 11*a* may be exhausted from the exhaust window 11*d* to the outside of the housing 50 via the exhaust ports 50*a* by the continued rotation of the cooling fan 11*b*.

The electric motor 11 may be powered by a battery pack 41 that is attached to the power supply section 40. The mechanism section 20 may be connected to the motor shaft 11*c* of the electric motor 11. The mechanism section 20 may include a driving shaft 22, a swinging arm 23, and a member that rotatably supports output shaft 24, where the members of the mechanism section are inside a mechanism case 21. The driving shaft 22 may be connected to the motor shaft 11*c* of the electric motor 11. The driving shaft 22 may be rotatably supported by the mechanism case 21 via bearings 22*a* and 22*b*. The driving shaft 22 may be rotatably supported around the motor axis M. Furthermore, an eccentric shaft 22*c* that is eccentrically located with respect to the motor axis M may be integrally formed with the driving shaft 22 at a front part thereof. A driving roller 25 may be attached to the eccentric shaft 22*c*.

Operating parts 23*a* of the swinging arm 23 may be brought into slide contact with the driving roller 25 in both the left and right directions. The left and right operating parts 23*a* may be integrally formed with a rear part of the swinging arm 23. The left and right operating parts 23*a* may extend in the rear direction in parallel at a predetermined space apart from each other. Furthermore, an output shaft 24 may be joined to a front part of the swinging arm 23. The output shaft 24 may be rotatably supported around an output axis P that is perpendicular to the motor axis M. The output shaft 24 may be supported by the mechanism case 21 via an upper bearing 24*a* and a lower bearing 24*b*.

When the electric motor 11 is run, the driving shaft 22 may rotate around the motor axis M. When the driving shaft 22 rotates around the motor axis M, the eccentric shaft 22*c* via its eccentric orientation revolves around the motor axis M. Consequently, displacement of the driving roller 25 in the left and right directions due to movement from the eccentric shaft 22*c* may be transferred to the swinging arm 23 via the left and right operating parts 23*a* while the driving roller 25 revolves around the motor axis M. Thus, the swinging arm 23 may swing about the output axis P in the left-right directions at a predetermined angle. Because of this movement, the output shaft 24 may rotate about the output axis P at the same predetermined angle.

A lower part of the output shaft 24 may protrude in a downward direction from a lower surface of the mechanism case 21. A tool holder 26 may be provided at the lower part of the output shaft 24. Furthermore, a tip tool T may be attached to the lower part of the output shaft 24 by inserting the tip tool T to the tool holder 26 and tightening a fixing screw 26*a* to fix the tip tool T. The tip tool T may be attached to the lower part of the output shaft 24, extending from the lower part of the output shaft 24 in the front direction (a direction orthogonal to the output axis P). As shown in FIGS. 1 and 2, a band-shaped saw blade (cutting saw blade) may be attached to the output shaft 24 as the tip tool T. The tip tool T may be swung at high speed at the predetermined angle around the output axis P, and a cutting work may be performed by use of a tip of the tip tool T. For example, a wooden material can be cutout using the tip tool T in a rectangular shape.

A start switch 12 that is slidably operated in the forward and rearward directions may be provided on the upper peripheral surface of the main body housing 51 (corresponding to the tool main body 10) of the housing 50. As shown in FIG. 3, an operation lever 13, which is integrally formed with the start switch 12, may be located below a lower surface of the start switch 12. The operation lever 13 may extend in the rearward direction along an inner surface of the housing 50. A rear portion of the operation lever 13 may be joined to a main switch 14 that is housed within the grip 30. When the start switch 12 is slidably operated (moved) in the forward direction (the start switch 12 is turned on), through the movement of operation lever 13, the main switch 14 may be switched on to run the electric motor 11. On the other hand, when the start switch 12 is slidably operated (moved) in the rearward direction (the start switch 12 is turned off), through the movement of operation lever 13, the main switch 14 may be switched off to stop the electric motor 11.

The grip 30, which can be held by a user with one hand, may be located proximate to the rear end of the tool main body 10. A grip housing 53 (corresponding to the grip 30) of the housing 50 may have a thickness and shape such that the user can easily hold the grip 30 with one hand. A speed controller for adjusting a rotation speed of the electric motor 11 may be located at the rear part of the grip 30. Furthermore, a rotary type adjustment dial 31*a* may be provided at the speed controller 31. As shown in FIGS. 2 and 3, an upper part of the adjustment dial 31*a* may protrude from a window 53*a* provided at an upper surface of the grip housing 53. A triangular indicator 53*b* for indicating an adjusted rotation speed of the electric motor 11 may be marked in front of the window 53*a*. The window 53*a* may be provided at a bottom part of a rectangular convex flange 53*c* that is formed in an inverted cone shape, as seen from the plan view in FIG. 2. The upper part of the adjustment dial 31*a* may protrude from the window 53*a* in such a way so as to not protrude from the concave part 53*c*. Because of this configuration, an inadvertent erroneous operation of the adjustment dial 31*a* may be prevented.

The power supply section 40 may be provided rearward of the grip 30. A power supply section housing 54, which houses the power supply section 40, may be integrally formed with and protrude and tilt in a diagonally downward direction from the grip housing 53. A main controller 43 for controlling the electric motor 11 may be housed in the power supply section housing 54. Although not shown in FIG. 3, the main controller 43 may be configured such that a control circuit board of the main controller 43, which molded with resin and is housed in a shallow rectangular case, comprises a motor control circuit and a power supply circuit.

A terminal stand 42 having positive and negative terminal plates 42*a* may be housed at the rear surface side of the main controller 43. A pair of rail receiving sections 44 for guiding the battery pack 41 may be provided at the left and right side directions of the terminal stand 42. The battery pack 41 which is slidably attached to the power supply section 40 may include a plurality of lithium ion cells housed in a case thereof. For example, the battery pack 41 may output 10.8 volts. A pair of guide rails 41*a* that engages with the pair of rail receiving sections 44 of the terminal stand 42 of the power supply section 40 may be provided on the front surface of the case comprising battery pack 41. Furthermore, positive and negative terminal receiving parts may be arranged between the pair of guide rails 41*a* on the battery pack 41.

The battery pack 41 may be attached to the power supply section 40 by sliding the battery pack 41 in the downward direction from an upward starting position relative to the terminal stand. On the other hand, from an attached position, the battery pack 41 may be removed from the power supply section 40 by sliding the battery pack 41 in the upward direction. Although not shown in the figures, a claw part for locking an attachment condition of the battery pack 41 with respect to the ten final stand of the power supply section 40 may be provided on the battery pack 41. Furthermore, as shown in FIG. 2, an unlock button 41*b* may be provide on the upper surface of the battery pack 41 for releasing the attachment lock condition by displacing the claw part to an unlock position relative to the power supply section 40. Subsequently, the battery pack 41 may be removed from the power supply section 41 and recharged for repeated use by a dedicated charger separately provided.

As discussed earlier, the power tool 1 may include the tubular housing 50 extending along the motor axis M, which comprises the left and right half-split housings. The housing 50 may be configured such that the left half-split housing 50L and the right half-split housing 50R are mated and screw-connected to each other. The front of the housing 50 may correspond to a mechanism section housing 52 of the mechanism section 20. The rear of the mechanism section housing 52 may correspond to the front of main body housing 51 of the tool main body 10. The rear of the main body housing 51 may correspond to the front of a grip housing 53 of the grip 30. Furthermore, the rear of the grip housing 53 may correspond to the front of the power supply section housing 54 of the power supply section 40.

As shown in FIG. 2, the left half-split housing 50L and the right half-split housing 50R of FIGS. 4 and 5, respectively, may be mated with each other on the mating surface J to form the tubular housing 50. FIGS. 4 and 5 show the left and right half-split housings 50L, 50R respectively seen from the right and left internal surface sides, respectively. Both the left and right half-split housings 50L, 50R may be provided with the mating surface J mainly along upper edge parts and lower edge parts thereof.

Outer circumferential surfaces of the left and right half-split housings 50L, 50R may be (partly or wholly) covered with elastic resin layer 55 in order to prevent slippage and/or reduce an impact of dropping etc. In FIGS. 4 and 5, the elastic resin layer 55 may be indicated by oblique lines in order to differentiate the elastic resin layer 55 from the mating surface J. Ribs 56 may be provided on the mating surface J in order to position the mating surface direction of the left and right half-split housings 50L, 50R (mainly in the upward and downward directions). As shown in FIG. 4, the ribs 56 may be provided on the mating surface J of the left half-split housing 50L. Each of the ribs 56 may have a thin-plate shape, and a plurality of ribs 56 may be provided along the mating surface J at appropriate intervals. As shown in FIG. 4, five ribs 56 may be provided on the upper edge part and two ribs on the lower edge part of the left half-split housing 50L (seven ribs 56 are provided in total).

Figure 6:
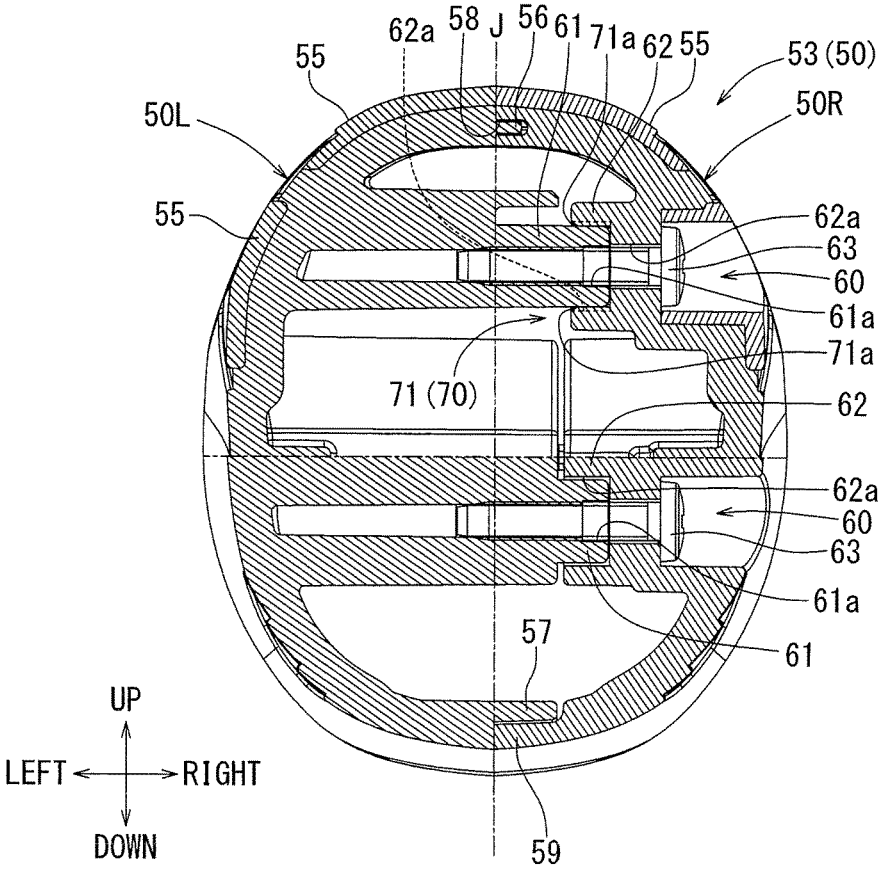
FIG. 6 is a figure showing a relative displacement restriction means of a first exemplary embodiment of the present disclosure, which is a cross-sectional view seen from arrows (VI)-(VI) in FIG. 3.
Figure 8:
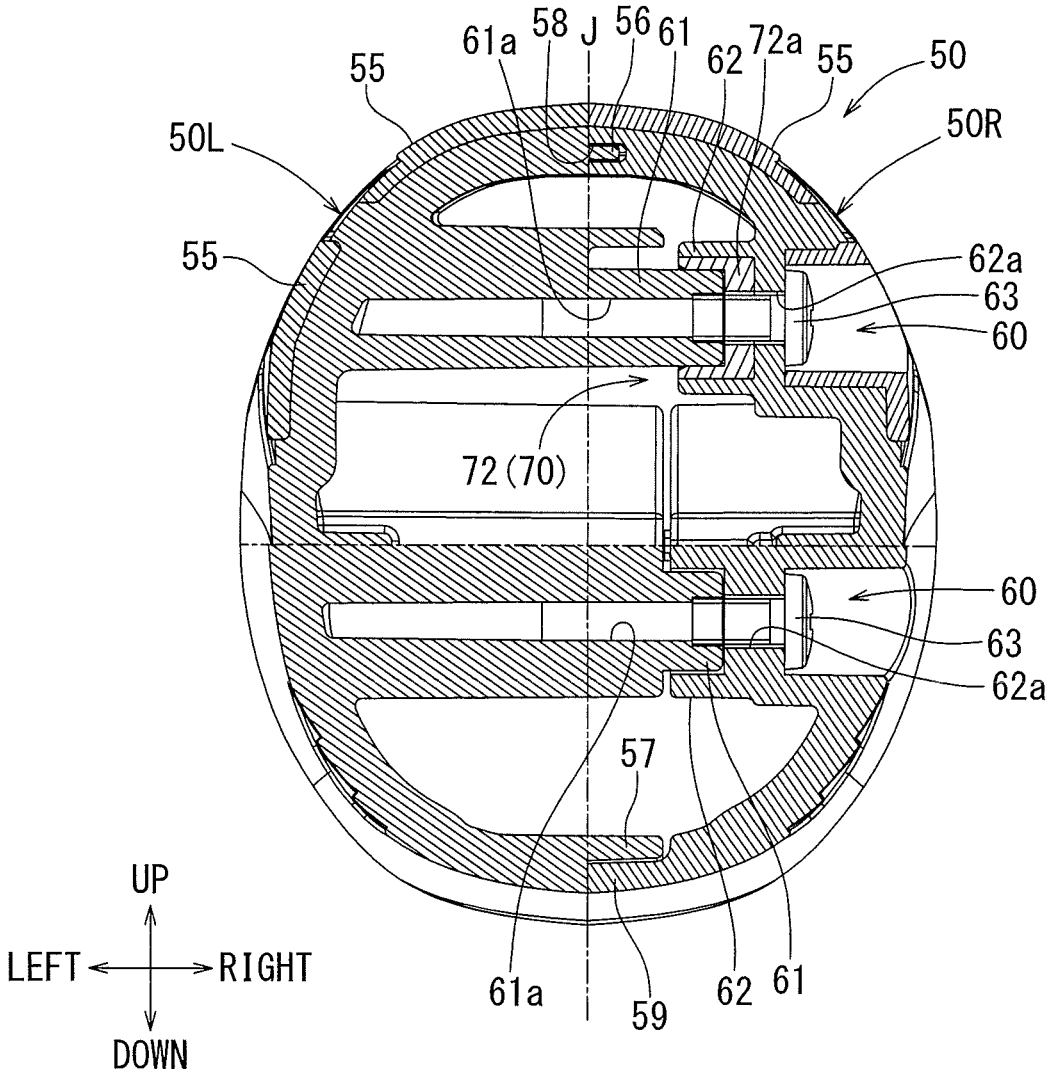
FIG. 8 is another figure showing a relative displacement restriction means of a second exemplary embodiment, which is a cross-sectional view seen from the same direction as from the arrows (VI)-(VI) in FIG. 3.
Figure 9:
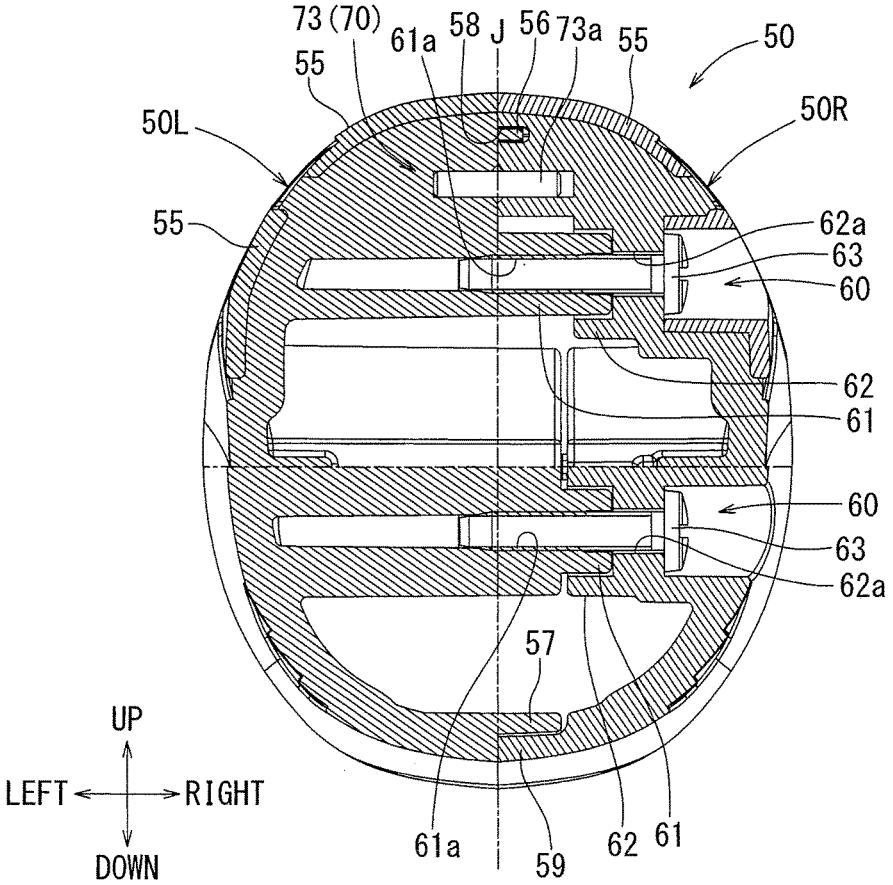
FIG. 9 is another figure showing a relative displacement restriction means of a third exemplary embodiment, which is a cross-sectional view seen from the same direction as from the arrows (VI)-(VI) in FIG. 3.

Corresponding to the location of each of the ribs 56 on the left half-split housing 50L, groove holes 58 may be respectively provided at corresponding locations on the mating surface J of the right half-split housing 50R. Each of the groove holes 58 may have an appropriate groove width and length such that the opposing and/or corresponding ribs 56 can be inserted thereinto. As shown in FIGS. 6, 8, and 9, the left half-split housing 50L may be mated with the right half-split housing 50R by inserting the ribs 56 into the corresponding groove holes 58. In this way, the left and right half-split housings 50L, 50R may be positioned in the mating direction and the mated housings 50L and 50R may be screw-connected to each other in the positioned state. Furthermore, the insertion of the ribs 56 into the corresponding groove holes 58 may restrict and/or prevent a positional displacement of the left and right half-split housings 50L, 50R in the mating surface direction, such that vibration etc. may not occur.

An auxiliary rib 57 may be provided at a lower end of the left half-split housing 50L, and an auxiliary rib 59 at a lower end of the right half-split housing 50R. As shown in FIG. 4, two auxiliary ribs 57 may be provided on the lower end of the mating surface J of the left half-split housing 50L. Similarly, as shown in FIG. 5, two auxiliary ribs 59 may be provided on the lower end of the mating surface J of the right half-split housing 50R. Each of the auxiliary ribs 57, 59 may be formed long along the mating surface J (extending in the longitudinal direction). The front auxiliary ribs 57 and 59 may be provided along the mating surface J of the main body housing 51. The rear auxiliary ribs 57 and 59 may be provided along the mating surface J from the grip housing 53 to the power supply section housing 54.

As shown in FIGS. 6, 8, and 9, the auxiliary ribs 57 of the left half-split housing 50L and the corresponding auxiliary ribs 59 of the right half-split housing 50R may be overlapped with each other in the left-right direction. Because of this overlapping construction, a positioning and/or a displacement prevention of the left half-split housing 50L with respect to the right half-split housing 50R may be performed in the upward and downward directions of the mating surface J. With regard to a structural configuration in which the auxiliary ribs 57 of the left half-split housing 50L are overlapped with the auxiliary ribs 59 of the right half-split housing 50R in the left-right direction, along the thickness of the tubular housing, the same configuration may be adopted in other embodiments discussed infra.

As shown in FIG. 1, the left and right half-split housings 50L, 50R may be screw-connected with each other where the components of the screw connection comprise screw-connection parts 60, at nine locations in total. Each of the screw-connection parts 60 may comprise a screw-boss part 61 included on the left half-split housing 50L, a boss-receiving part 62 included on the right half-split housing 50R, and a screw 63 for screw-connecting the left and right half-split housings 50L, 50R.

As shown in FIG. 4, nine screw-boss parts 61 each having a screw hole 61*a* for fastening the screws 63 may be provided on the inner surface of the left half-split housing 50L as seen from the right side. Each of the screw-boss parts 61 may be provided in a protruding direction from the inner surface of the left half-split housing 50L toward the right half-split housing 50R, with which the left half-split housing 50L mates. Furthermore, the screw hole 61*a* has a predetermined depth and may be provided on the protruding side. Three screw-boss parts 61 may be provided on the inner surface of the mechanism section housing 52 of the left half-split housing 50L. Two screw-boss parts 61 may be provided on the inner surface of the main body housing 51 of the left half-split housing 50L. Two screw-boss parts 61 may be provided on the inner surface of the grip housing 53 of the left half-split housing 50L. Furthermore, two screw-boss parts 61 may be provided on the inner surface of the power supply section housing 54 of the left half-split housing 50L. Furthermore, in addition to the three screw-boss parts 61 provided on the mechanism section housing 52, three case-fixing parts 64 each having a screw hole 64*a* for fixing the mechanism section case 21 may be provided on the inner surface of the mechanism section housing 52 of the left half-split housing 50L.

As shown in FIG. 5, nine boss-receiving parts 62 in total may be provided on the inner surface of the right half-split housing 50R, corresponding to the nine screw-boss parts 61 of the left half-split housing 50L. Each of the boss-receiving parts 62 may have a cylindrical shape such that the screw-boss part 61 can be inserted thereinto. An insertion hole 62*a* for inserting the screw 63 may be provided at a bottom center of each boss-receiving part 62. By inserting the screw 63 into the insertion hole 62*a* from the right half-split housing 50R and fastening the screw 63 to the screw hole 61*a* of the left half-split housing 50L, the left half-split housing 50L may be firmly connected to the right half-split housing 50R in a mating manner to jointly form the tubular housing 50. Conversely, when all of the screws 63 are removed from the nine screw-connection parts 60, the left half-split housing 50L may be separated from the right half-split housing 50R.

Figure 7:
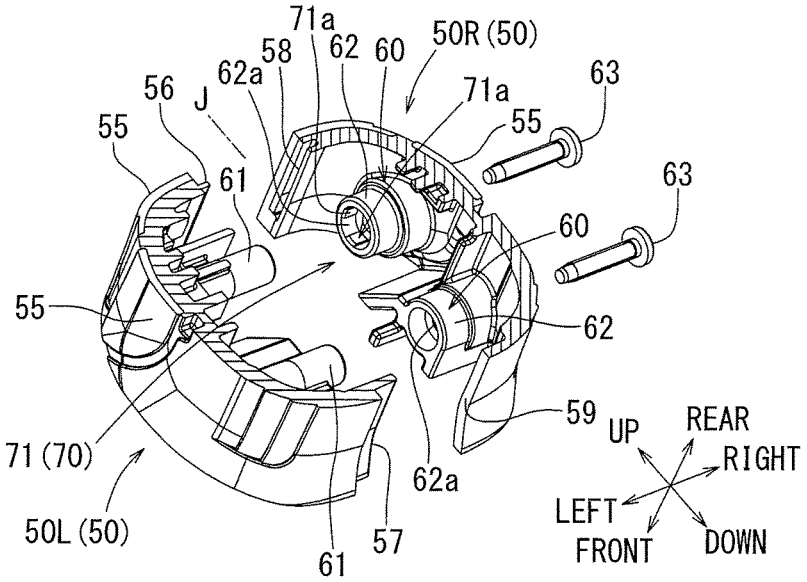
FIG. 7 is an exploded perspective view of FIG. 6, showing the housing in a sliced manner including the relative displacement restriction means of the first embodiment.

A means for restricting a displacement in a mutual separation direction (hereinafter, referred to as a relative displacement restriction means 70) may be provided between the left half-split housing 50L and the right half-split housing 50R. Hereinafter, several embodiments with respect to the relative displacement restriction means 70 may be described below. As shown in FIGS. 5 to 7, a relative displacement restriction means 71 of the first embodiment may be configured such that a press-fitting protrusion 71*a* may be provided on an inner surface of the boss-receiving part 62. The press-fitting protrusion 71*a* may be provided at an upper screw-connection part 60 of the two screw-connection parts 60 that are located in the grip housing 53 of the right half-split housing 50R. A degree of rub and/or vibration, which may potentially occur without the displacement restriction means between the mating surface J of the left and right half-split housings 50L, 50R, would be presumed to be larger in the vicinity of the upper screw-connection part 60. As a result, the relative displacement restriction means 71 is provided at this place in the first embodiment.

In the upper screw-connection part 60 of grip housing 53 of the right half-split housing 50R, four press-fitting protrusions 71*a* may be provided on the outer periphery of the inner circumferential surface of the boss-receiving part 62 at equal intervals (four protrusions equally spaced in the circumferential direction). Due to the presence of the press-fitting protrusions 71*a* on the outer periphery of the inner circumferential surface, an (actual) inner diameter of the upper boss-receiving part 62 may become smaller than that of the other eight boss-receiving parts 62. Hence, the inner diameter of the upper boss-receiving part 62 may be appropriately sized such that the protruding tip part of the screw-boss part 61 of the left half-split housing 50L can be inserted thereinto.

Because of this configuration, in a state where the left and right half-split housings 50L, 50R are connected to each other, the screw-boss part 61 may be press-fit to an inner peripheral hole of the boss-receiving part 62 in the upper screw-connection part 60 located in the grip housing 53. On the other hand, for the other eight screw-connection parts 60, each of the corresponding screw-boss parts 61 may be inserted into the corresponding inner peripheral holes of the corresponding boss-receiving part 62 without any resistance. In this way, in one of the nine screw-connection parts 60 (the upper screw-connection part 60 located in the grip housing 53), the screw-boss part 61 may be press-fit to the screw-receiving part 61 because of the press-fitting protrusions 71*a*. In this manner, a resistance in the separating direction (separation resistance) may be generated between the left and right half-split housings 50L, 50R. Thus, even if all of the screws 63 are loosened in the screw-connection parts 60, the left and right half-split housings 50L, 50R may still be kept in a mating configuration with respect to each other, with the retaining force of the separation resistance of the upper screw-connection part 60 located in grip housing 53 present. In the first embodiment, the separation resistance by the press-fitting protrusions 71*a* (a retaining force for retaining the housings in the mating manner) may be configured such that when, for example, the housing 50 is held in a horizontal left-to-right direction with only one of the half-split housings being held by the user, the other of the half-split housings may not be separated (may not fall) due to its own weight by gravity. In the first embodiment, a protruding size of the four press-fitting protrusions 71*a* in the direction of the inner diameter from the outer periphery of the inner circumferential surface of the boss receiving part 62 may be appropriately set in order to generate the separation resistance desired.

The separation resistance for retaining the left and right half-split housings 50L, 50R in the mating configuration (with press-fit separation resistance present) with respect to each other may also dually serve as a resistance for restricting a displacement of the left and right half-split housings 50L, 50R in the mating surface direction J (in a direction perpendicular to the separation direction). Due to the nature of the separation resistance obtained by the press-fitting protrusions 71*a* (relative displacement restriction means 70) via the press fit structural configuration as described, a relative displacement (rub and/or vibration) of the left and right half-split housings 50L, 50R may be restricted in the direction of the mating surface J, which effectively prevents and/or restricts heat from generating on the mating surface J.

According to the relative displacement restriction means 71 in the first embodiment discussed above, the screw-boss part 61 may be press-fit to the inner circumferential surface of the boss-receiving part 62 in one of the nine screw-connection parts 60 as described above, by which the left and right half-split housings 50L, 50R are connected with each other (are not easily separated from each other). Under the press-fitting condition, the appropriate resistance (separation resistance) may be obtained between the left and right half-split housings 50L, 50R through configuration of the press-fit configuration and sizing of protrusions 71*a* as described above. Because of the presence of the separation resistance, the relative displacement of the left and right half-split housings 50L, 50R may be restricted in the direction of the mating surface J. Thus, rub and/or vibration on the mating surface J can be restricted, which may restrict heat generation.

FIG. 8 shows a relative displacement restriction means 72 of a second embodiment. The relative displacement restriction means 72 of the second embodiment may be configured such that instead of the four press-fitting protrusions 71*a*, a tubular rubber bush 72*a* is inserted into and/or fittedly mounted to the outer periphery of the inner circumferential surface of the boss-receiving part 62. The tip end of the screw-boss part 61 may then be press-fit to the inner circumferential surface of the rubber bush 72*a*. In this way, as with the first embodiment, separation resistance may be generated in one of the screw-connection parts 60 of the left and right half-split housings 50L, 50R.

As discussed above, because of the relative displacement restriction means 72 (the rubber bush 72*a*) of the second embodiment, the separation resistance may be generated between the left and right half-split housings 50L, 50R. Because of this separation resistance, the relative displacement of the left and right half-split housings 50L, 50R may not only be restricted in the horizontal left-to-right direction, but may also be restricted in the longitudinal direction of the mating surface J. Thus, rub and/or vibration of the mating surface J can be restricted, which may restrict heat generation.

Figure 10:
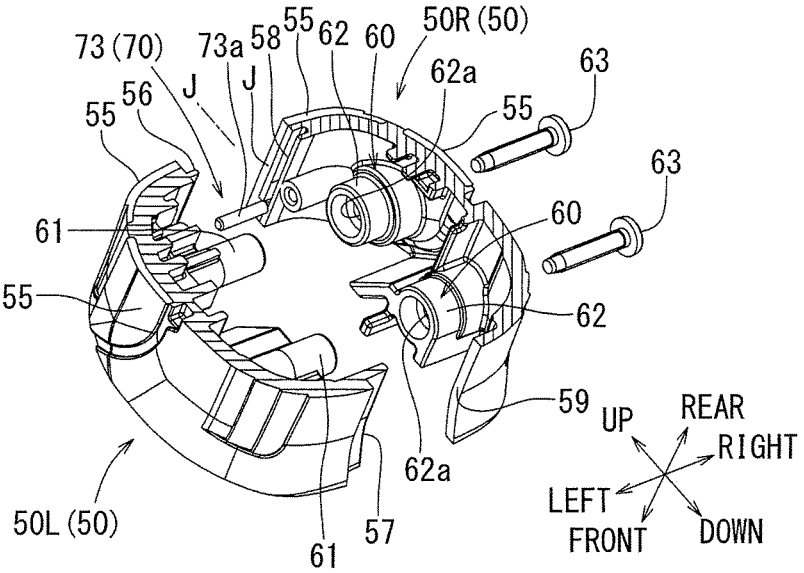
FIG. 10 is an exploded perspective view of FIG. 9, showing the housing in a sliced manner including the relative displacement restriction means of the third embodiment.

FIGS. 9 and 10 show a relative displacement restriction means 73 of a third embodiment. The relative displacement restriction means 73 of the third embodiment may be configured such that the separation resistance can be generated between the left and right half-split housings 50L, 50R by use of a press-fitting pin 73*a*. In the third embodiment, the press-fitting pin 73*a* may be press-fitted between the mating surface J of the left and right half-split housings 50L, 50R along and/or in the vicinity of the upper screw-connection part 60 located in the grip housing 53. Because of the press-fitting pin 73*a*, the separation resistance, as present in the other embodiments above, may be obtained between the left and right half-split housings 50L, 50R. As a result, the relative displacement may not only be restricted in the horizontal left-to-right direction, but may also be restricted in the direction of mating surface J, where rub and/or vibration between the mating surface J of the left and right half-split housings 50L, 50R can be restricted, which may restrict heat generation.

Figure 11:
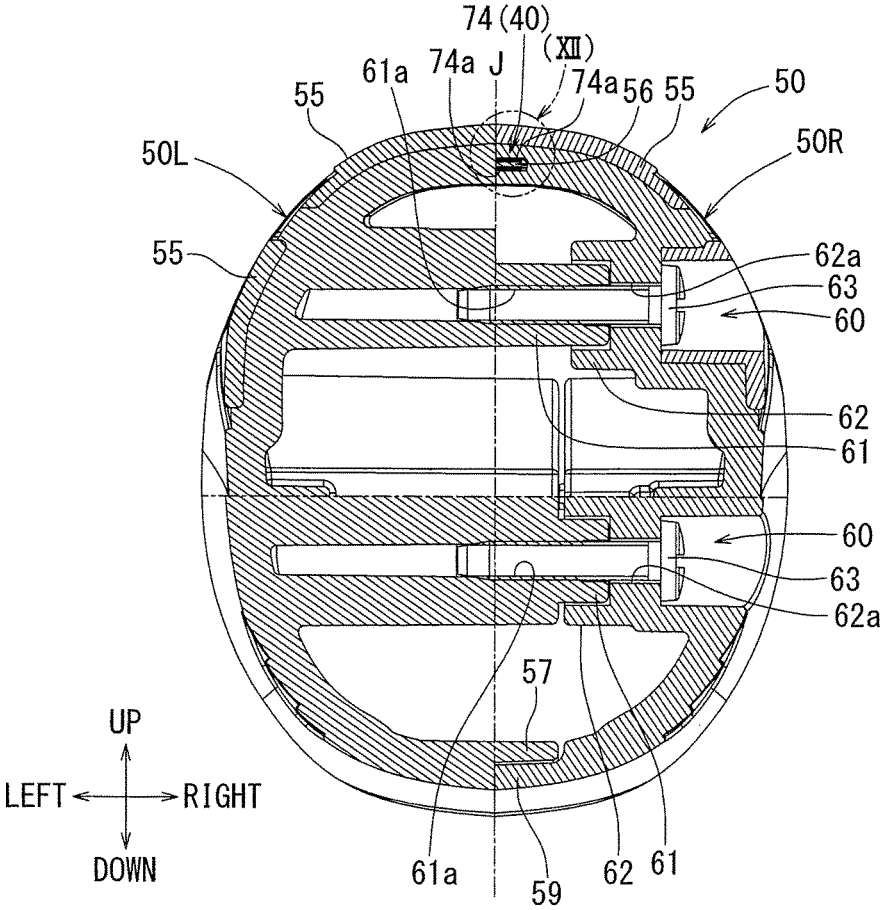
FIG. 11 is another figure showing a relative displacement restriction means of a fourth exemplary embodiment, which is a cross-sectional view seen from the same direction as from the arrows (VI)-(VI) in FIG. 3.
Figure 12:
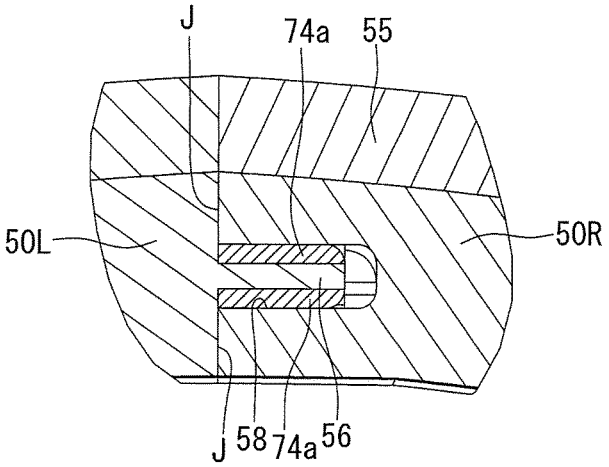
FIG. 12 is an enlarged view of (XII) in FIG. 11, showing a cross sectional view of a press-fitting state of a rib with respect to a rib-receiving part.
Figure 13:
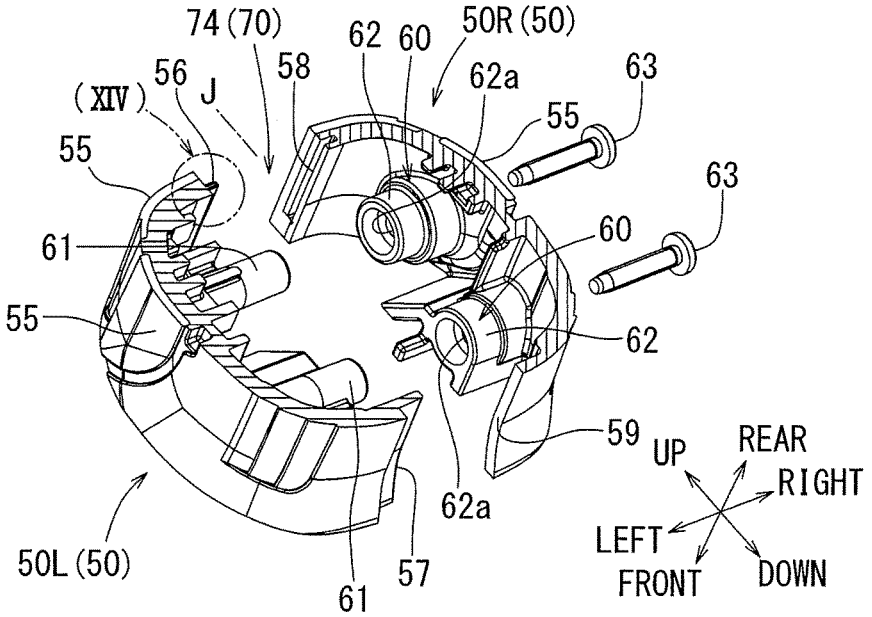
FIG. 13 is an exploded perspective view of FIG. 11, showing the housing in a sliced manner including the relative displacement restriction means of the fourth embodiment.
Figure 14:
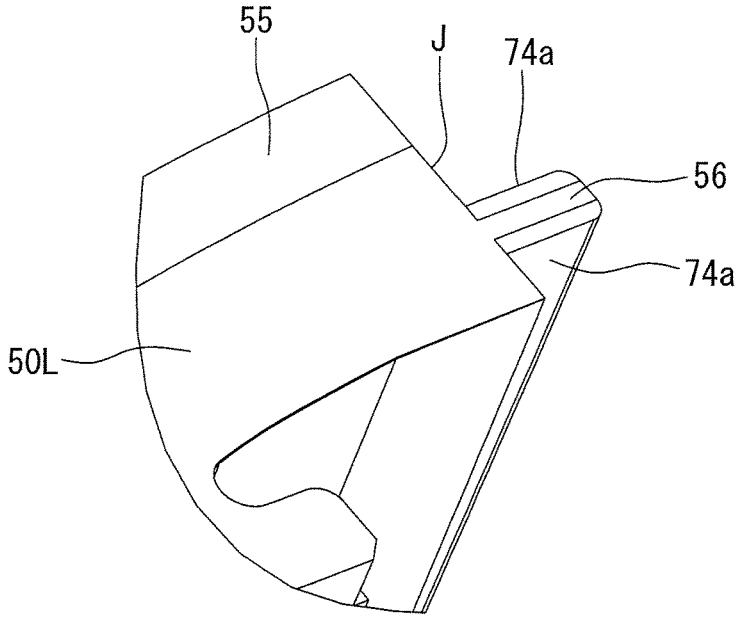
FIG. 14 is an enlarged perspective view of (XIV) in FIG. 13, showing a rib and its surroundings.

FIGS. 11 to 14 shows a relative displacement restriction means 74 of a fourth embodiment. The relative displacement restriction means 74 of the fourth embodiment may be configured such that instead of the press-fitting pin 73*a*, a rib 56 of the left half-split housing 50L may be press-fit to a groove hole 58 of the right half-split housing 50R, which generates separation resistance between the left and right half-split housings 50L, 50R. In the fourth embodiment, a rubber sheet 74*a* may be attached to the rib 56 to obtain a necessary press-fitting margin to contact the inner peripheral surface of the groove hole 58. The rubber sheet 74*a* may be attached to both the outside and inside surfaces of the rib 56 (upside and downside surfaces of the rib 56 as shown in FIG. 12). As shown in FIGS. 11 and 12, the rubber sheet 74*a* may be attached to the both sides of the rib 56, and the rib 56 with the rubber sheet 74*a* may be press-fit to the groove hole 58. By press-fitting the rib 56 with the rubber sheet 74*a* to the groove hole 58, the separation resistance may be generated between the left and right half-split housings 50L, 50R. As a result, the relative displacement may not only be restricted in the horizontal left-to-right direction, but may also be restricted in the direction of mating surface J, where rub and/or vibration (relative displacement) between the mating surface J of the left and right half-split housings 50L, 50R may be restricted, and thus heat generated in this area may be restricted.

Figure 15:
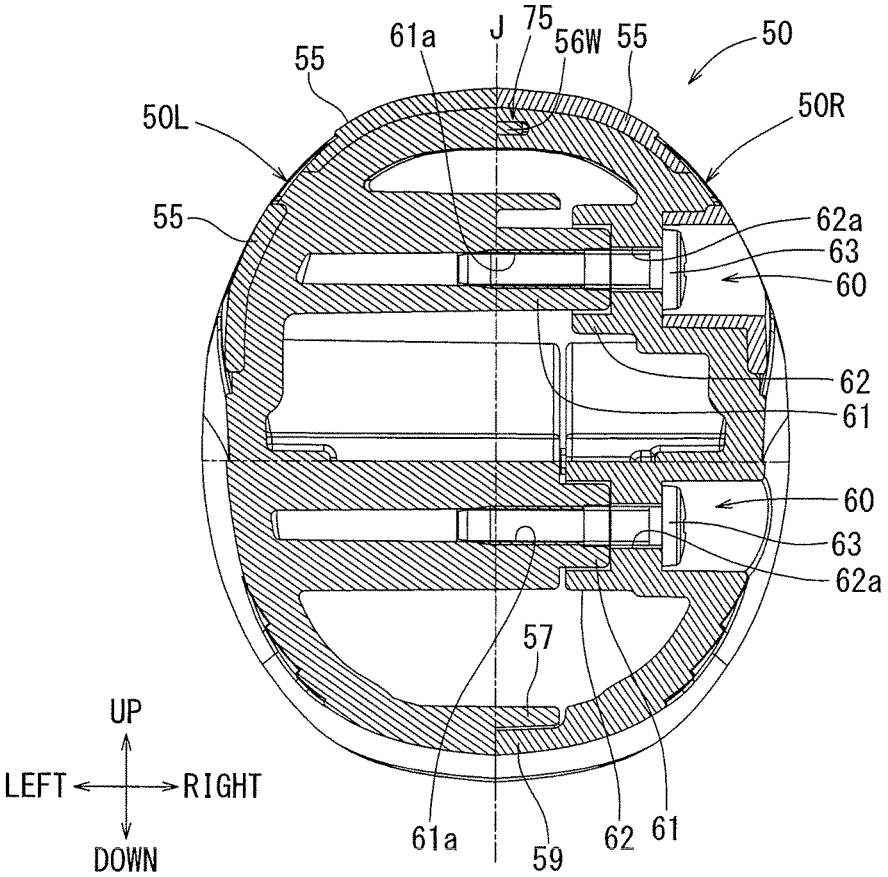
FIG. 15 is another figure showing a relative displacement restriction means of a fifth exemplary embodiment, which is a cross-sectional view seen from the same direction as from the arrows (VI)-(VI) in FIG. 3.
Figure 16:
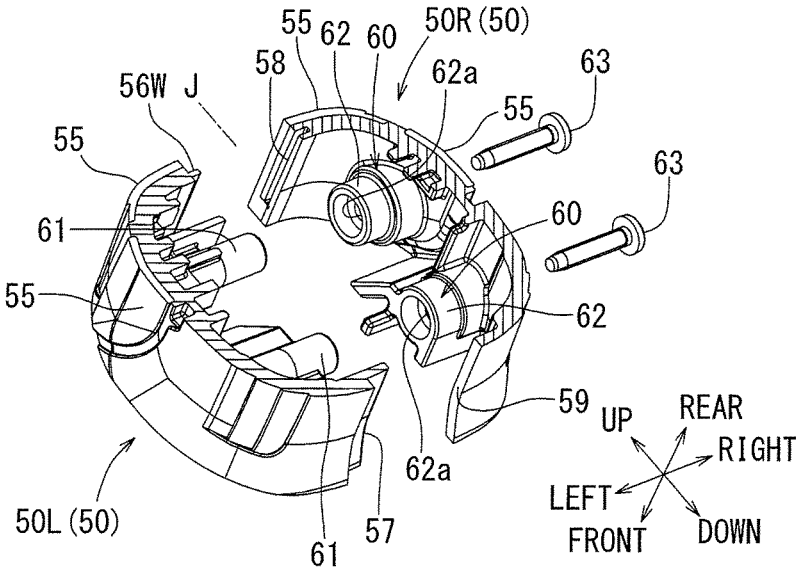
FIG. 16 is an exploded perspective view of FIG. 15, showing the housing in a sliced manner including the relative displacement restriction means of the fifth embodiment.

FIGS. 15 and 16 show a relative displacement restriction means 75 of the fifth embodiment. The relative displacement restriction 75 of the fifth embodiment may be configured such that a thickness of the rib 56 of the left half-split housing 50L in the grip housing 53, relative to the rib 56 of the fourth embodiment described above, is increased to obtain a necessary a press-fitting margin. In FIGS. 15 and 16, a symbol W may be added to the rib 56 whose thickness is increased to add the press-fitting margin. In the fifth embodiment, the rubber sheet 74*a* may not be attached to the rib 56 to obtain the press-fitting margin unlike in the fourth embodiment, but the thickness of the rib 56 itself may be increased (the rib 56 having an increased thickness may be formed by molding) to obtain the press-fitting margin to contact the inner peripheral surface of groove hole 58 on its own. By press-fitting the rib 56W to the groove hole 58, the relative displacement restriction may be obtained between the left and right half-split housings 50L, 50R. As a result, in the fifth embodiment, the relative displacement may not only be restricted in the horizontal left-to-right direction, but may also be restricted in the direction of mating surface J, where rub and/or vibration (relative displacement) between the mating surface J of the left and right half-split housings 50L, 50R may be restricted, and thus heat generation may be restricted.

Figure 17:
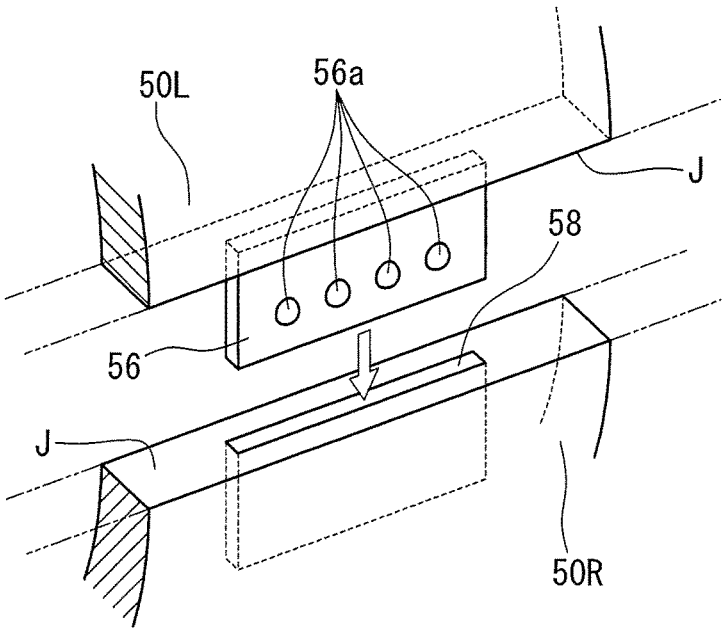
FIG. 17 is a perspective view of a press-fitting rib formed in a protruding shape and a rib-receiving part.
Figure 18:
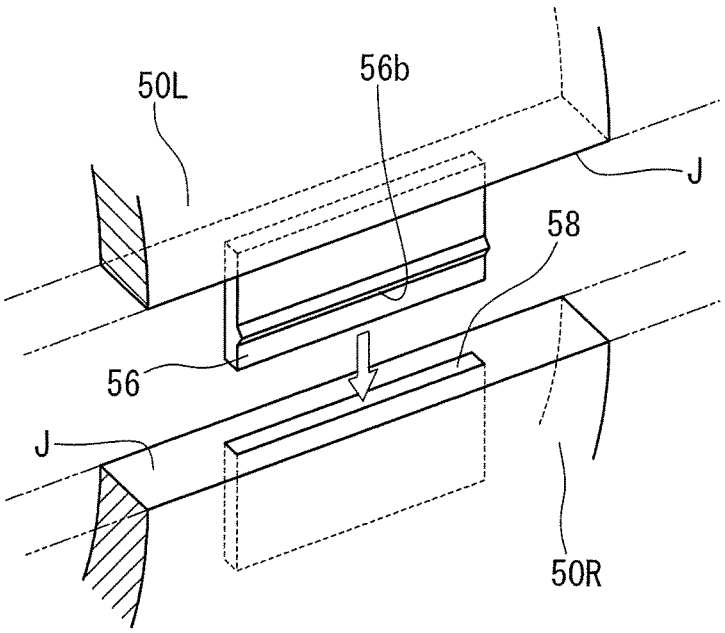
FIG. 18 is a perspective view of a press-fitting rib formed in an extending projection shape and a rib-receiving part.
Figure 19:
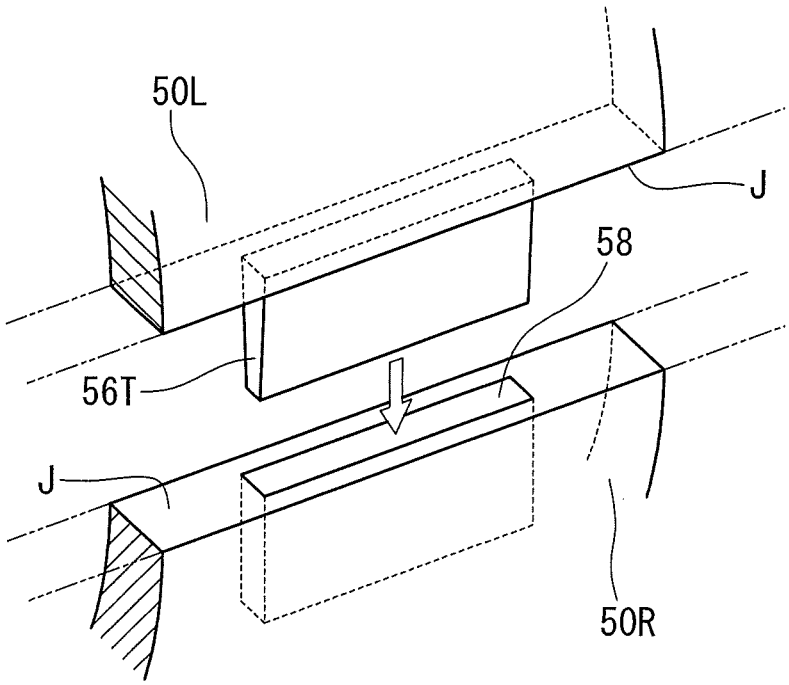
FIG. 19 is a perspective view of a press-fitting rib formed in a tapered shape and a rib-receiving part.

As discussed above, the rubber sheet 74 may be attached to the rib 56 in the fourth embodiment and the thickness of the rib 56 itself may be increased in the fifth embodiment in order to press-fit the (positioning) rib 56 provided on the mating surface J to the groove hole 58. Other than the aforementioned embodiments, an additional relative displacement restriction means (press-fitting structure) embodiment may be adopted as shown in FIGS. 17 to 19. The press-fitting structure shown in FIG. 17 may be such that a plurality of protrusions 56*a* are provided on a surface of the rib 56 or both surfaces of the ribs 56 to obtain the necessary press-fitting margin. By press-fitting the rib 56 having the protrusions 56*a* to the groove hole 58, the separation resistance may be generated between the left and right half-split housings 50L, 50R. As a result, the relative displacement may not only be restricted in the horizontal left-to-right direction, but may also be restricted in the direction of mating surface J, where rub and/or vibration on the mating surface J may be restricted, and eventually heat generation in this area may be restricted. FIG. 17 shows four protrusions 56*a*, but more than four protrusions may be provided to obtain the press-fitting margin. Other than this configuration, for example, another configuration in which only one protrusion is provided on either one surface of the rib 56 may be adopted.

Furthermore, as shown in FIG. 18, instead of the protrusion(s) 56*a* discussed above, the necessary press-fitting margin may be obtained by providing a projection 56*b* extending in a longitudinal direction of the rib 56 on a surface or both surfaces of the rib thereof. FIG. 18 shows one projection 56*b* on one surface of the rib 56, but the projection 56*b* may be provided on the opposite side as well, thus being present on both surfaces of the rib 56. Furthermore, other constructions in which a plurality of projections are provided on one surface of the rib 56 in order to obtain the necessary press-fitting margin may be contemplated.

FIG. 19 shows another press-fitting structure (an additional relative displacement restriction means embodiment). The press-fitting structure shown in FIG. 19 may be configured such that a rib 56T formed in a tapered shape is press-fitted to the groove hole 58 to generate the separation resistance between the left and right half-split housings SOL, 50R. A thickness of the rib 56T may be continuously reduced (i.e. may be tapered) toward its extending tip side. By press-fitting the tapered rib 56 to the groove hole 58, the separation resistance may be generated between the left and right half-split housings 50L, 50R. As a result, the relative displacement may not only be restricted in the horizontal left-to-right direction, but may also be restricted in the direction of mating surface J, where rub and/or vibration on the mating surfaces J may be restricted, and eventually heat generation may be restricted.

As discussed above, the relative displacement restriction means 71, 72, 73, 74, and 75 may provide the separation resistance in the left and right half-split housings SOL, 50R in order to restrict not only relative displacement in the horizontal left-to-right direction, but also relative displacement (rib and/or vibration) between the mating surface J, which eventually restricts heat from being generated. In the press-fitting configurations of the second to fifth embodiments and those shown in FIGS. 17 to 19, the separation resistance between the left and right half-split housing 50*l*, 50R (the retaining force for retaining the housings in the mating manner) may be configured such that when, for example, the housing 50 is held in a horizontal direction with only one of the half-split housings being held, the other of the half-split housings may not be separated (may not fall) due to its own weight. In addition, the relative displacement may not only be restricted in the horizontal left-to-right direction, but may also be restricted in the direction of mating surface J, where because of this configuration, rub and/or vibration between the mating surfaces J may be effectively reduced, which can restrict heat from being generated.

In the first embodiment, the relative displacement restriction means 71 may be provided in the upper boss-receiving part 62 of the grip housing 53. However, the relative displacement restriction means 71 of the first embodiment may be provided in another boss-receiving part 62 or in a plurality of boss-receiving parts 62 selected from the nine boss-receiving parts 62 in total such that the separation resistance can be generated. Similarly, this alternate or plural placement of the means may also be applied to the press-fitting structure of the second to fifth embodiments. In the second to fifth embodiments, the press-fitting margin may be provided in the upper edge side rib 56 of the grip housing 53, or the press-fitting pin 73*a* may be inserted in the vicinity of the rib 56. However, the exemplified press-fitting structure may be applied to the other rib 56 or a plurality of ribs 56 selected from the seven ribs 56 in total.

In the above-discussed embodiments, the press-fitting margin may be provided in the rib 56. However, instead of the ribs 56, the press-fitting margin may be provided in the groove hole 58 into which the rib 56 is inserted.

Figure 20:
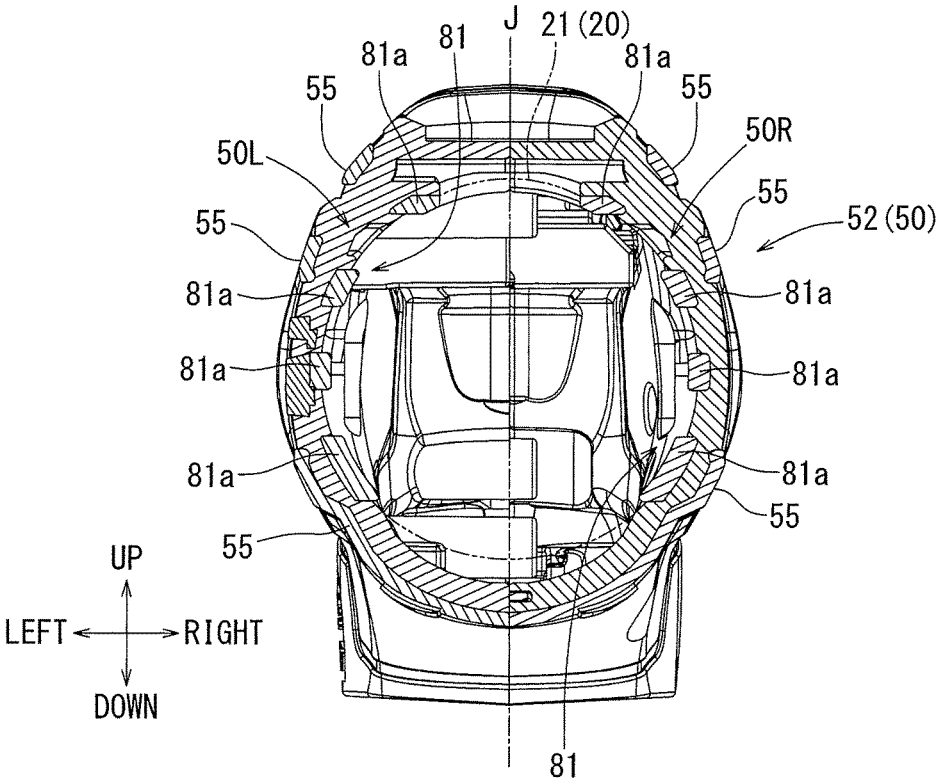
FIG. 20 is a cross-sectional view of the housing, which is seen from arrows (XX)-(XX) in FIG. 5.

In addition to the above discussed relative displacement restriction means, countermeasures against vibration and/or countermeasures for absorbing impacts at the time of falling etc. may be taken in the embodiments of the power tool 1. FIG. 20 shows a means for restricting vibration of the housing 50 transferred from the mechanism section 20. A first impact absorption member 81 may be provided on the internal surface of the left and right half-split housings 50L, 50R. In more detail, the first impact absorption member 81 may be provided on the front side of the mechanism section housing 52 of the housing 50. As shown in FIG. 20, the first impact absorption member 81 may be provided in a substantially bilaterally symmetrical manner around the mechanism section housing 21 of the left and right half-split housings 50L, 50R. As shown in FIGS. 5 and 20, the first impact absorption member 81 may include four absorbing protrusions 81*a* on each side, for the left and right sides. The four absorbing protrusions 81*a* may be arranged at appropriate angular intervals and in a parallel configuration relative to each other in a circumferential direction, each extending in the forward and rearward directions. The four absorbing protrusions 81*a* may be formed integrally with an outer-surface-side elastic resin layer 55 by double molding at the time of molding of the half-split housings. The same elastic resin as used in the outer-surface-side elastic resin layer 55 may also be used in the four absorbing protrusions 81*a*.

In assembling of the mechanism section 20 with regard to the housing 50, each of the absorbing protrusions 81*a* at the front side 52 of the mechanism section housing may be pressed against an outer surface of the mechanism case 21. In this configuration, the mechanism case 21 may thus support the housing 50 via the left and right first impact absorption member 81. Because of the first impact absorption member 81, vibration generated in the mechanism section 20, and in particular vibration caused by swing movement of the swinging arm 23, may be absorbed, and eventually vibration of the housing 50 may be reduced. Furthermore, because of the first impact absorption member 81, vibration of the left and right half-split housings 50L, 50R may be reduced, and thus rub and/or vibration on the mating surface J may be reduced. As a result, heat generated in this area may be restricted.

Figure 21:
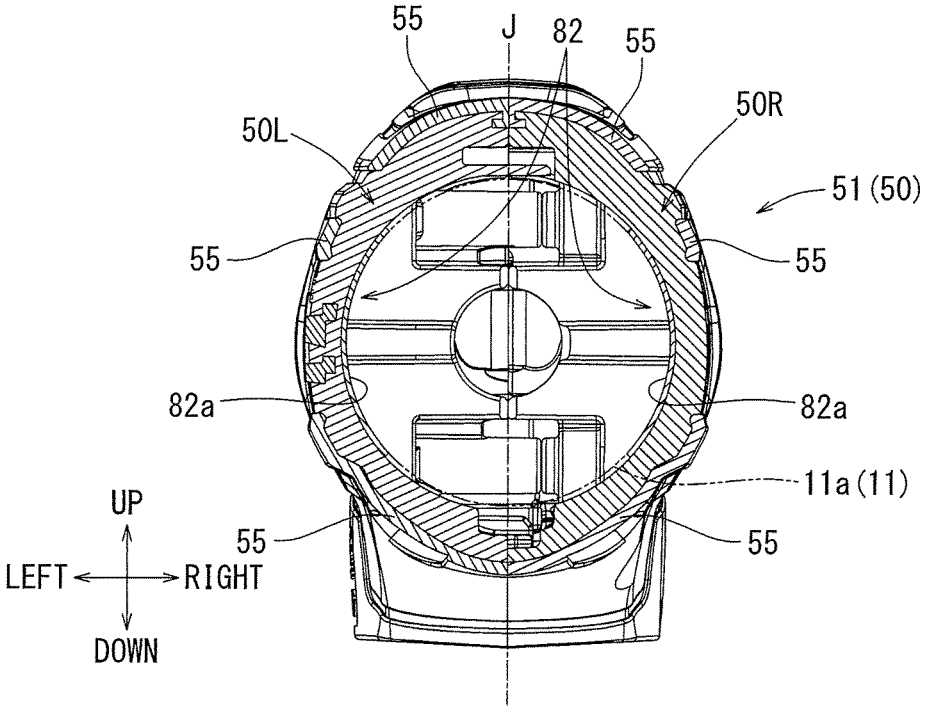
FIG. 21 is a cross-sectional view of the housing, which is seen from arrows (XXI)-(XXI) in FIG. 5.

Furthermore, as shown in FIG. 21, a second impact absorption member 82 for absorbing vibration of the electric motor 11 may be provided on the inner surface of the left and right half-split housings 50L, 50R. The second impact absorption member 82 may be provided in the main body housing 51 of the housing 50. The second impact absorption member 82 may comprise a pair of rubber sheets 82*a* provided along the inner surface of left and right half-split housings 50L, 50R. In assembling of the electric motor 11 with regard to the housing 50, the pair of rubber sheets 82*a* having appropriate elasticity may be pressed against the outer circumferential surface of the motor case 11*a*. Because of this construction, vibration occurring in the electric motor 11 may be absorbed, and eventually vibration of the housing 50 may be reduced. By reducing vibration of the left and right half-split housings 50L, 50R through the absorption by the second impact absorption member 82, rub and/or vibration on the mating surface J may be reduced, and eventually heat generated in this area may be restricted.

Figure 22:
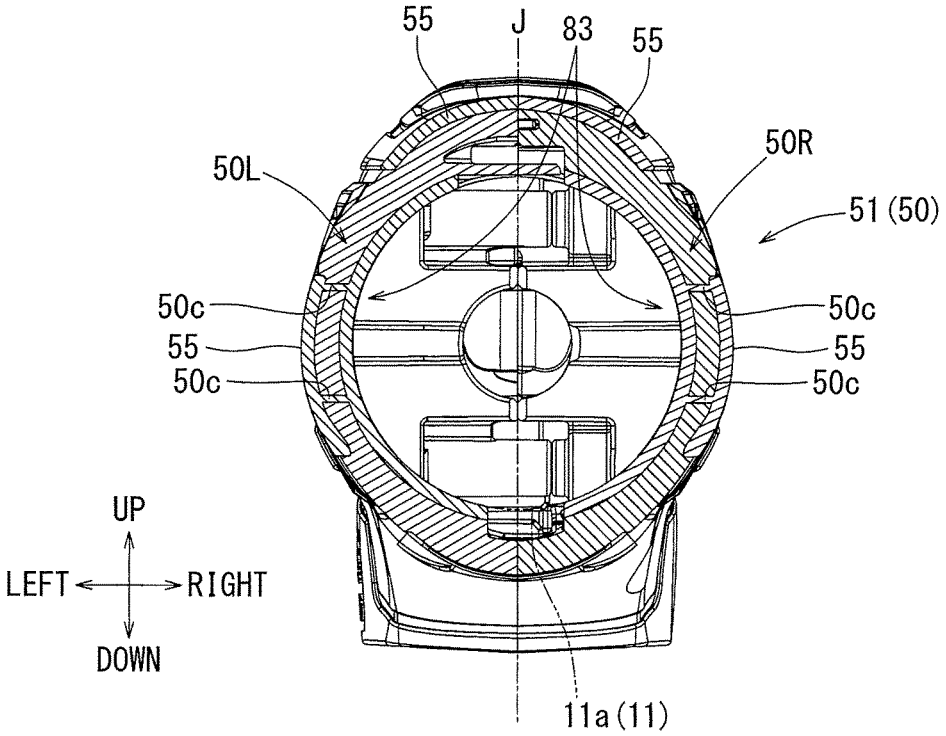
FIG. 22 is a cross-sectional view of the housing, which is seen from arrows (XXII-(XXII) in FIG. 5.

As shown in FIG. 22, a pair of ventilation seals 83 for closing a gap between an outer surface of the motor case 11*a* and the internal surface of the right and left half-split housings 50L, 50R may be provided in the main body housing 51 of the housing 50. The ventilation seal 83 may be circumferentially provided along the inner periphery of the left and right half-split housings 50L, 50R.

Because of the pair of ventilation seals 83, the gap between the outer surface of the motor case 11*a* and the internal surface of the right and left half-split housings 50L, 50R may be closed in front of the exhaust window 11*d*. As a result, because the gap is closed in front of the exhaust window 11*d*, the air that is exhausted from the exhaust window 11*d* cannot flow in the forward direction, which thereby prevents the exhaust air from entering again into the motor case 11*a*. In this respect, due to the presence of the ventilation seals 83, exhaust efficiency of the electric motor 11 can be improved, and further cooling efficiency of the electric motor 11 can be improved. Furthermore, by arranging similar ventilation seals to 83 at the back of the exhaust window 11*d*, exhaust and/or cooling efficiency of the electric motor 11 may be further improved.

At the time of molding elastic resin layer 55 covered on the outer surface of the housing 50, the pair of ventilation seals 83*a* may be formed (molded) by pouring molten resin material via resin casting ports 50*c* provided in the left and right half-split housings 50L, 50R to the inner face side thereof. In this manner of molding construction, the pair of ventilation seals 83*a* may be simultaneously formed by the same material as the elastic resin layer 55 located outside the ventilation seals 83*a*.

Figure 23:
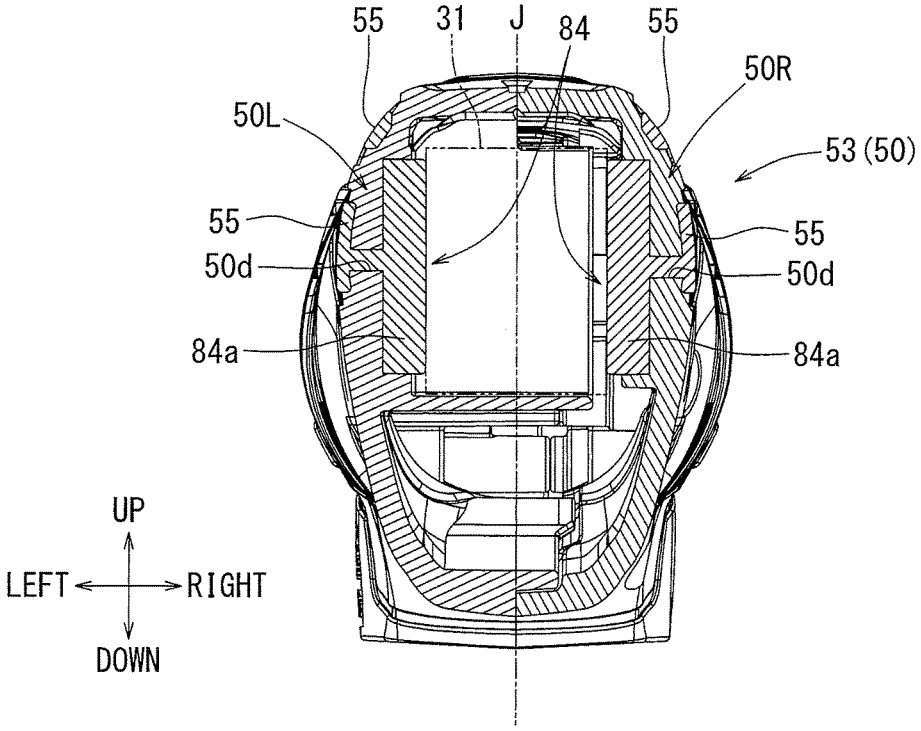
FIG. 23 is a cross-sectional view of the housing, which is seen from arrows (XXIII)-(XXIII) in FIG. 5.

As shown in FIG. 23, a fourth impact absorption member 84 for reducing vibration of the speed controller 31 and reducing impact of dropping the housing 50 may be provided on the inner side of the left and right half-split housings 50L, 50R at the rear of the main body housing 51 of the housing 50. The fourth impact absorption member 84 may be provided with a pair of cushioning elements 84*a* that are in contact with the left and right sides of the speed controller 31. The speed controller 31 may be cushioned against the inner periphery of the housing 50 and supported by the cushioning elements 84*a* that are in contact with the left and right sides of the speed controller 31. Because of this construction of cushioning elements, the vibration attributed to and/or of the speed controller 31 may be reduced, and in case the device is dropped, an impact of the dropping of the housing 50 upon the speed controller 31 may also be reduced. As a result, durability and/or reliability of the speed controller 31 can be improved and also malfunction of the speed controller 31 can be prevented.

Similar to the molding formation of the ventilation seals 83 as described above, at the time of molding elastic resin layer 55 covered on the outer surface of the housing 50, the cushioning elements 84*a* of the fourth impact absorption member 84 may be formed (molded) by pouring molten resin material via resin casting ports 50*d* provided in the left and right half-split housings 50L, 50R to the inner face side thereof. In this manner, the cushioning elements 84*a* may be simultaneously formed by the same material as the elastic resin layer 55 located outside the cushioning elements 84*a*.

Figure 24:
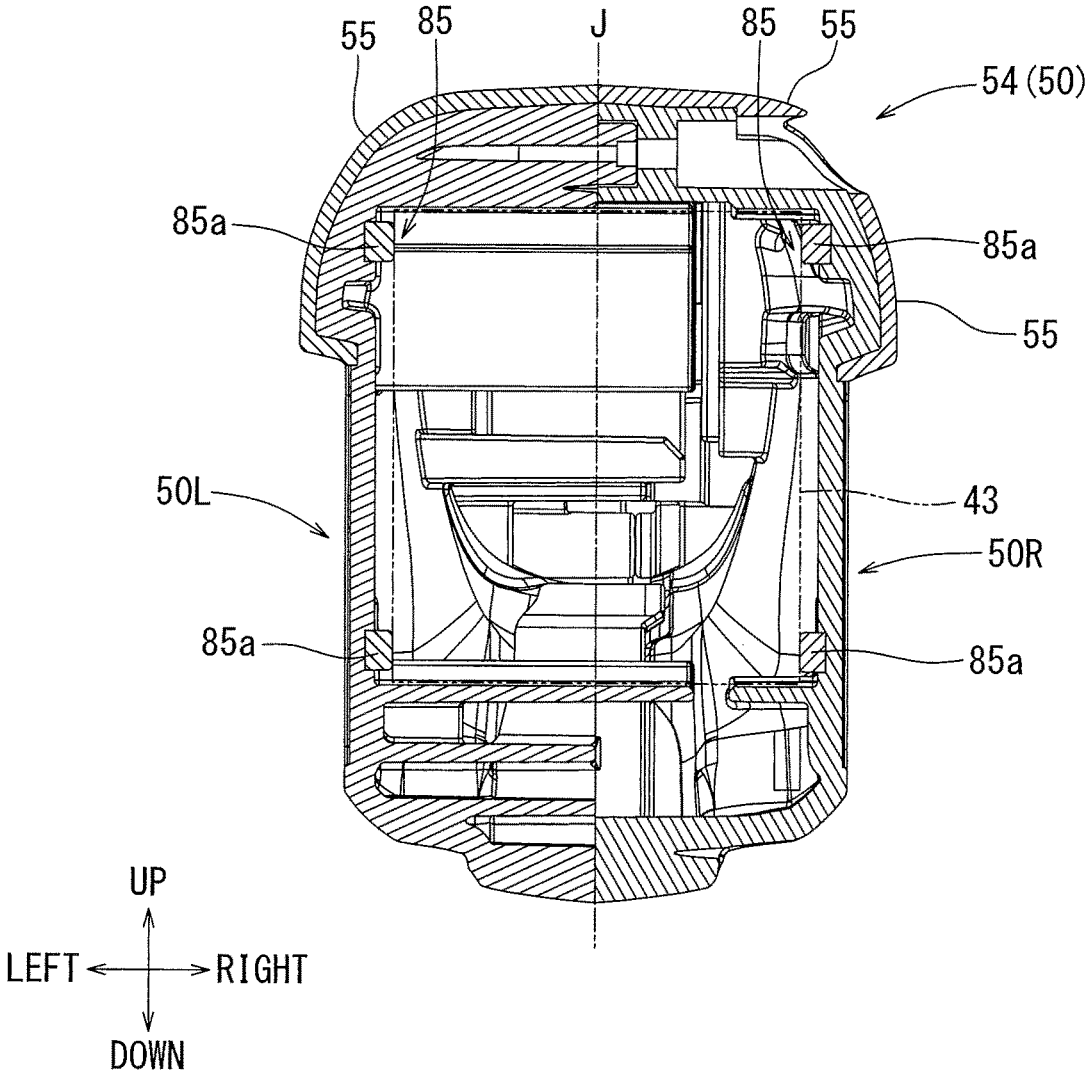
FIG. 24 is a cross-sectional view of the housing, which is seen from arrows (XXIV)-(XXIV) in FIG. 5.

As shown in FIG. 24, a fifth impact absorption member 85 for reducing vibration of the main controller 43 may be provided on the inner surface of the left and right half-split housings 50L, 50R of the power supply section housing 54 of the housing 50. The fifth impact absorption member 85 may be provided with four cushioning elements 85*a* in total that are in the vicinity of and in contact with each corner of the main controller 43. Each of the cushioning members 85*a* may be formed in a block shape. Similar to the ventilation seals 83 and the fourth impact absorption member 84, the cushioning elements 85*a* of the fifth impact absorption member 85 may be simultaneously formed by pouring molten resin material via resin casting ports at the time of molding elastic resin layer 55. The main controller 43 may be cushioned against the inner periphery of the housing 50 and supported by the cushioning elements 85*a* that are in contact with the left and right sides of the main controller 43. Because of this construction, vibration of the main controller 43 may be reduced, and in case the device is dropped, an impact of dropping the housing 50 on the main controller 43 may also be reduced. As a result, durability and/or reliability of the main controller 43 can be improved and also malfunction of the main controller 43 can be prevented.

The present invention is not limited to the embodiments discussed above and may be further modified without departing from the scope and spirit of the present teachings. In the first and second embodiments of the present disclosure, the screw-boss part 61 may be configured to be press-fit into the insertion hole 62*a* of the boss-receiving part 62 in the upper screw-connection part 60 of the grip housing 53. However, the press-fit construction discussed above is not limited to this configuration and may be applied to another screw-connection part 60 as well. Furthermore, the press-fit construction may be applied to a plurality of screw-connection parts 60, for example, three screw-connection parts 60.

In the first embodiment of the present disclosure, the press-fitting protrusion 71*a* may be provided in the insertion hole 62*a* of the boss-receiving part 62, and in the second embodiment, the rubber bush 72*a* may be inserted into the insertion hole 62*a*, in order to press-fit the screw-boss part 61 into the insertion hole 62 of the boss-receiving part 62. However, the screw-boss part 61 may instead be configured to have the press-fitting margin to press-fit into the insertion hole 62*a* of the boss-receiving part 62. Furthermore, the screw-boss part 61 may be configured to be formed in a tapered shape to press-fit into the insertion hole 62*a* of the boss-receiving part 62.

In the third embodiment, the press-fitting pin 73*a* may be press-fit between the left and right half-split housings 50L, 50R in the vicinity of the upper screw-connection part 60 of the grip housing 53. However, the press-fitting pin 73*a* is not limited to this configuration, and may instead be located in the vicinity of another screw-connection part 60, and furthermore a plurality of press-fitting pins formed in a similar shape to the pin 73*a* may be press-fit between the left and right half-split housings 50L, 50R.

In the fourth and fifth embodiments, the upper edge side rib 56 of the grip housing 53 may be press-fit to the groove-hole 58. However, instead of this figuration, the rib 56 located in another portion of the device may be press-fit to its respective groove hole, and furthermore a plurality of the ribs 56 may be press-fit to the groove-holes, in order to generate separation resistance between the left and right half-split housings 50L, 50R. The point is that the relative displacement restriction means 70 may be applied to the mating surface J where large degree of rub and/or vibration might occur, such that an adequate separation resistance can be generated between the left and right half-split housings 50L. 50R, whereby rub and/or vibration may be reduced on the mating surface direction of the mating surface J to restrict heat generation.

In the embodiments, the multifunction power tool described may represent an exemplary embodiment of the power tool. However, the present teaching is not limited to this embodiment, and may also be applied to vibration drills, screw fastening devices, cutting devices, and any other electric power tools. Furthermore, instead of the battery pack, the present teaching may be applied to the power tool in a case where power may be supplied to the power tool by a mains AC power source such as a 100V commercial power source.

In the embodiments, the half-split structure represented by the described left and right half-split housings 50L, 50R may represent an exemplary embodiment of the housing 50 of the power tool 1. However, the relative displacement restriction means 70 may be applied to another case where a front housing is mated to a front portion of a tubular main body housing, a main body housing is mated to a rear portion of the rear housing, or left and right half-split housings of a grip housing are mated with each other, whereby rub and/or vibration on the mating surface may be reduced and heat generation may be prevented.

What is claimed is:

1. A power tool comprising:

a motor;

a drive mechanism driven by the motor;

a main body housing that (1) houses the motor and the drive mechanism, (2) is comprised of a first half-split housing and a second half-split housing, where the first half-split housing is attached to the second half-split housing via one or more screws that are received in and engage one or more screw bosses of the first half-split housing and the second half-split housing and (3) includes a grip (a) located at a rear part of the main body housing behind the drive mechanism and (b) configured for a user to hold during operation of the power tool;

an output shaft that rotates around an output shaft rotation axis that is perpendicular to a motor rotation axis of the motor; and a tip tool that is attached to a lower portion of the output shaft, wherein:

the first half-split housing and the second half-split housing include a relative displacement restriction member other than engagement of the one or more screws with the one or more screw bosses for restricting a relative displacement of the first half-split housing with respect to the second half-split housing;

the relative displacement restriction member is spaced, along the main body housing, from a combination of a first of the one or more screws and a first of the one or more screw bosses that does not include the relative displacement restriction member;

the relative displacement restriction member is located in the grip;

the first half-split housing and the second half-split housing are located on opposite sides of the motor rotation axis;

an entirety of the relative displacement restriction member is located on an opposite side from the tip tool with regard to (1) the motor and (2) the motor rotation axis; and the combination of the first of the one or more screws and the first of the one or more screw bosses that does not include the relative displacement restriction member is on a same side as the tip tool with respect to the motor rotation axis.

2. The power tool according to claim 1, wherein the relative displacement restriction member includes a press-fitting member.

3. The power tool according to claim 2, wherein:

the second half-split housing includes one or more boss-receiving parts into which the one or more screw bosses are inserted such that each one of the one or more screw bosses is received in one of the one or more boss-receiving parts; and at least one of the one or more boss-receiving parts includes a press-fitting protrusion serving as the press-fitting member that is configured such that one of the one or more screw bosses is press-fit to the at least one of the one or more boss-receiving parts.

4. The power tool according to claim 2, wherein, a press-fitting pin provided in the first half-split housing and serving as the press-fitting member is press-fit in a corresponding press-fitting hole provided in the second half-split housing.

5. The power tool according to claim 2, wherein, the first half-split housing includes a first mating surface;

the second half-split housing includes a second mating surface;

the first mating surface and the second mating surface abut when the first half-split housing and the second half-split housing are attached;

a rib serving as the press-fitting member is provided on the first mating surface;

a rib-receiving part into which the rib is inserted is provided on the second mating surface; and the rib and the rib-receiving part are configured such that the rib is press-fit to the rib-receiving part, restricting the relative displacement between the first half-split housing and the second half-split housing.

6. The power tool according to claim 5, wherein:

a protrusion is provided on the rib; and the protrusion is configured to be elastically deformed such that the rib is press-fit to the rib-receiving part.

7. The power tool according to claim 5, wherein:

a plurality of ribs are provided on the first mating surface.

8. The power tool according to claim 1, wherein:

the first half-split housing includes a first mating surface on an outer side of the first half-split housing and the second half-split housing includes a second mating surface on an outer side of the second half-split housing;

the first mating surface mates with the second mating surface to form the main body housing of the power tool when the first half-split housing is directly attached to the second half-split housing;

the first half-split housing and the second half-split housing are connected by the one or more screws passing through the first mating surface and the second mating surface;

each of the first mating surface and the second mating surface includes holes to receive the screws;

the relative displacement restriction member is located in one of the holes in the first mating surface, the relative displacement restriction member extending in a radial direction of the one of the holes and partially encompassing the screw;

the second mating surface includes bosses defining the holes of the second mating surface;

one of the bosses is received in the relative displacement restriction member to restrict a relative displacement of the first half-split housing with respect to the second half-split housing along the first and second mating surfaces.

9. The power tool according to claim 8, wherein the relative displacement restriction member is disposed away from the drive mechanism on an opposite side of the drive mechanism with respect to the motor in a longitudinal direction of the tool body housing.

10. The power tool according to claim 8, wherein the one of the holes that includes the relative displacement restriction member is located above another hole that does not include the relative displacement restriction member in approximately a vertical direction of the first half-split housing.

11. The power tool according to claim 1, wherein the relative displacement restriction member interacts with one of the one or more screw bosses, but not with others of the one or more screw bosses.

12. The power tool according to claim 1, wherein the relative displacement restriction member is directly between the first half-split housing and the second half-split housing.

13. The power tool according to claim 1, wherein:

the second half-split housing includes one or more boss-receiving parts into which the one or more screw bosses are inserted such that each one of the one or more screw bosses is received in one of the one or more boss-receiving parts; and the relative displacement restriction member is between the one or more screw bosses of the first half-split housing and a corresponding one or more boss-receiving parts of the second split-housing.

14. The power tool according to claim 13, wherein, the relative displacement restriction member is on an inner surface of the boss-receiving part.

15. The power tool according to claim 3, wherein, the press-fitting protrusion is on an inner surface of the boss-receiving part.

16. The power tool according to claim 15, wherein, a plurality of the press-fitting protrusions are on an outer periphery of the inner surface of the boss-receiving part of equal intervals.

17. A power tool comprising:

a tubular housing (1) extending along an axis of a motor shaft of a motor contained within the tubular housing, (2) comprising a first half-split housing and a second half-split housing, where the first half-split housing is directly attached to the second half-split housing via one or more screws that are received in and engage one or more screw bosses of the first half-split housing, and (3) that includes a grip configured for a user to hold during operation of the power tool;

an output shaft that rotates around a rotation axis that is perpendicular to the axis of the motor shaft; and a tip tool that is attached to a lower portion of the output shaft, wherein:

each of the one or more screw bosses includes a first internal cavity having a first diameter into which a screw of the one or more screws is inserted and fastened;

the second half-split housing includes one or more boss-receiving parts that receive the one or more screw bosses, each of the one or more boss-receiving parts having a second internal cavity with a second diameter;

at least one of the one or more boss-receiving parts includes a press-fitting protrusion extending in a radial direction of the at least one of the one or more boss receiving parts (1) that partially encompasses the screw and (2) that restricts a relative displacement of the first half-split housing with respect to the second half-split housing in a mutual separation direction, as well as in a direction perpendicular to the mutual separation direction;

the second diameter is larger than the first diameter;

at least one of the one or more screw bosses is received in and engaged by the at least one of the one or more boss-receiving parts in a press-fit configuration;

the press-fitting protrusion is located in the grip;

the first half-split housing and the second half-split housing are located on opposite sides of the rotation axis;

an entirety of the press-fitting protrusion is located on an opposite side from the tip tool with regard to (1) the motor and (2) the axis of the motor shaft; and one or more boss-receiving parts that does not include the press-fitting protrusion is on a same side as the tip tool with respect to the axis of the motor shaft.

18. The power tool according to claim 17, wherein:

a tubular rubber bush serving as the press-fitting protrusion is located inside the second cavity; and the tubular rubber bush partially encompasses the one of the one or more of the screw bosses in a press-fit configuration.

19. The power tool according to claim 17, wherein:

the each of the one or more boss-receiving parts that includes the press-fitting protrusion is spaced, along the tubular housing, from another of the one or more boss-receiving parts that does not include the press-fitting protrusion.

20. The power tool according to claim 18, wherein:

the at least one of the one or more boss-receiving parts that includes the tubular rubber bush is located above another boss receiving part that does not include the tubular rubber bush in approximately a vertical direction of the second half-split housing.

21. The power tool according to claim 17, wherein:

the tubular housing has a motor case in its interior comprising an exhaust window;

the motor is housed within the motor case and exhausts air through the exhaust window; and ventilation seals close a gap between the exhaust window at an outer peripheral surface of the motor case and an internal surface of the first and second half-split housings, such that air exhausted through the exhaust window is prevented from entering the motor case again through the exhaust window.

22. A power tool comprising:

a tubular housing (1) extending along an axis of a motor shaft of a motor contained within the tubular housing, (2) comprising a first half-split housing and a second half-split housing, where the first split housing is directly attached to the second half-split housing via one or more screws that are received in an engaged one or more screw bosses of the first half-split housing, and (3) that includes a grip configured for a user to hold during operation of the power tool;

an output shaft that rotates around a rotation axis that is perpendicular to the axis of the motor shaft; and a tip tool that is attached to a lower portion of the output shaft, wherein:

each of the one or more screw bosses includes a first internal cavity having a first diameter into which a screw of the one or more screws is inserted and fastened;

the second half-split housing includes one or more boss-receiving parts that receive the one or more screw bosses, each of the one or more boss-receiving parts having a second internal cavity with a second diameter;

at least one of the one or more boss-receiving parts includes a position restriction member extending in a radial direction of the at least one of the one or more boss-receiving parts (1) that partially encompasses the screw and (2) that restricts a relative displacement of the first half-split housing with respect to the second half-split housing;

the position restriction member is located in the grip;

the first half-split housing and the second half-split housing are located on opposite sides of the rotation axis;

an entirety of the position restriction member is located on an opposite side from the tip tool with regard to (1) the motor and (2) the axis of the motor shaft; and one or more boss-receiving parts that does not include the position restriction member is located on a same side as the tip tool with respect to the axis of the motor shaft.

23. The power tool according to claim 22, wherein:

the first half-split housing includes a first mating surface on an outer side of the first half-split housing;

the second half-split housing includes a second mating surface on an outer side of the second half-split housing;

the first mating surface mates with the second mating surface to comprise the grip;

a plurality of the position restriction members are disposed on an outer periphery of the inner surface of the boss-receiving part at equal intervals;

the one of the boss-receiving parts that includes the position restriction member is located above another boss-receiving parts that does not include the position restriction member in approximately a vertical direction of the first half-split housing; and the relative displacement of the first half-split housing with respect to the second half-split housing is configured to be restricted along the first and second mating surfaces.

24. The power tool according to claim 1, wherein the first and second half-split housings are disposed in a left and right direction relative to a plane defined by the output shaft rotation axis and the motor rotation axis, when the tip tool is disposed in a downward direction.

25. The power tool according to claim 17, wherein the first and second half-split housings are disposed in a left and right direction relative to a plane defined by the rotation axis of the output shaft and the axis of the motor, when the tip tool is disposed in a downward direction.

* * * * *